US005878728A

United States Patent [19]

Kidokoro et al.

[11] Patent Number: 5,878,728

[45] Date of Patent: Mar. 9, 1999

[54] FAILURE DIAGNOSIS APPARATUS FOR EVAPORATIVE PURGE SYSTEM

[75] Inventors: Toru Kidokoro, Hadano; Naoya Takagi, Susono, both of Japan

[73] Assignee: Toyota Jidosha Kabushiki Kaisha, Toyota, Japan

[21] Appl. No.: 870,670

[22] Filed: Jun. 6, 1997

[30] Foreign Application Priority Data

Jun. 11, 1996 [JP] Japan ..... 8-149380
Jan. 14, 1997 [JP] Japan ..... 9-004765

[51] Int. Cl.[6] ..... F02M 37/04

[52] U.S. Cl. ..... 123/520; 123/519

[58] Field of Search ..... 123/516, 518, 123/519, 520, 198 D

[56] References Cited

U.S. PATENT DOCUMENTS

| | | | |
|---|---|---|---|
| 5,396,873 | 3/1995 | Yamanaka et al. | 123/520 |
| 5,398,662 | 3/1995 | Igarashi et al. | 123/520 |
| 5,460,143 | 10/1995 | Narita | 123/520 |
| 5,542,397 | 8/1996 | Takahata et al. | 123/520 |
| 5,590,634 | 1/1997 | Shinohara | 123/520 |
| 5,592,923 | 1/1997 | Machida | 123/520 |

FOREIGN PATENT DOCUMENTS

| | | |
|---|---|---|
| 4-362264 | 12/1992 | Japan . |
| 5-180099 | 7/1993 | Japan . |
| 5-256215 | 10/1993 | Japan . |
| 6-74104 | 3/1994 | Japan . |
| 6-108930 | 4/1994 | Japan . |
| 7-151022 | 6/1995 | Japan . |

OTHER PUBLICATIONS

U.S. Appln. No. 998,191, filed Dec. 29, 1992.
U.S. Appln. No. 006,902, filed Jan. 21, 1993.
U.S. Appln. No. 982,280, filed Nov. 25, 1992.

*Primary Examiner*—Thomas N. Moulis
*Attorney, Agent, or Firm*—Kenyon & Kenyon

[57] ABSTRACT

A back-pressure chamber of a tank internal pressure regulating valve and a canister are connected to each other by a communicating passage. During purging, since the negative pressure in an evaporative purge system is introduced into the back-pressure chamber, the valve opening pressure setting of the tank internal pressure regulating valve is lowered. As purge-cutting is started, the internal pressure of the canister instantly rises to the valve opening pressure of an air intake valve, thereby increasing the pressure introduced into the back-pressure chamber. Consequently, the valve opening pressure setting of the tank internal pressure regulating valve rises, thereby suppressing the valve opening operation. Thus, diagnosis is prevented from becoming erroneous as the pressure regulating valve in the evaporative purge system opens during the failure diagnosis.

9 Claims, 17 Drawing Sheets

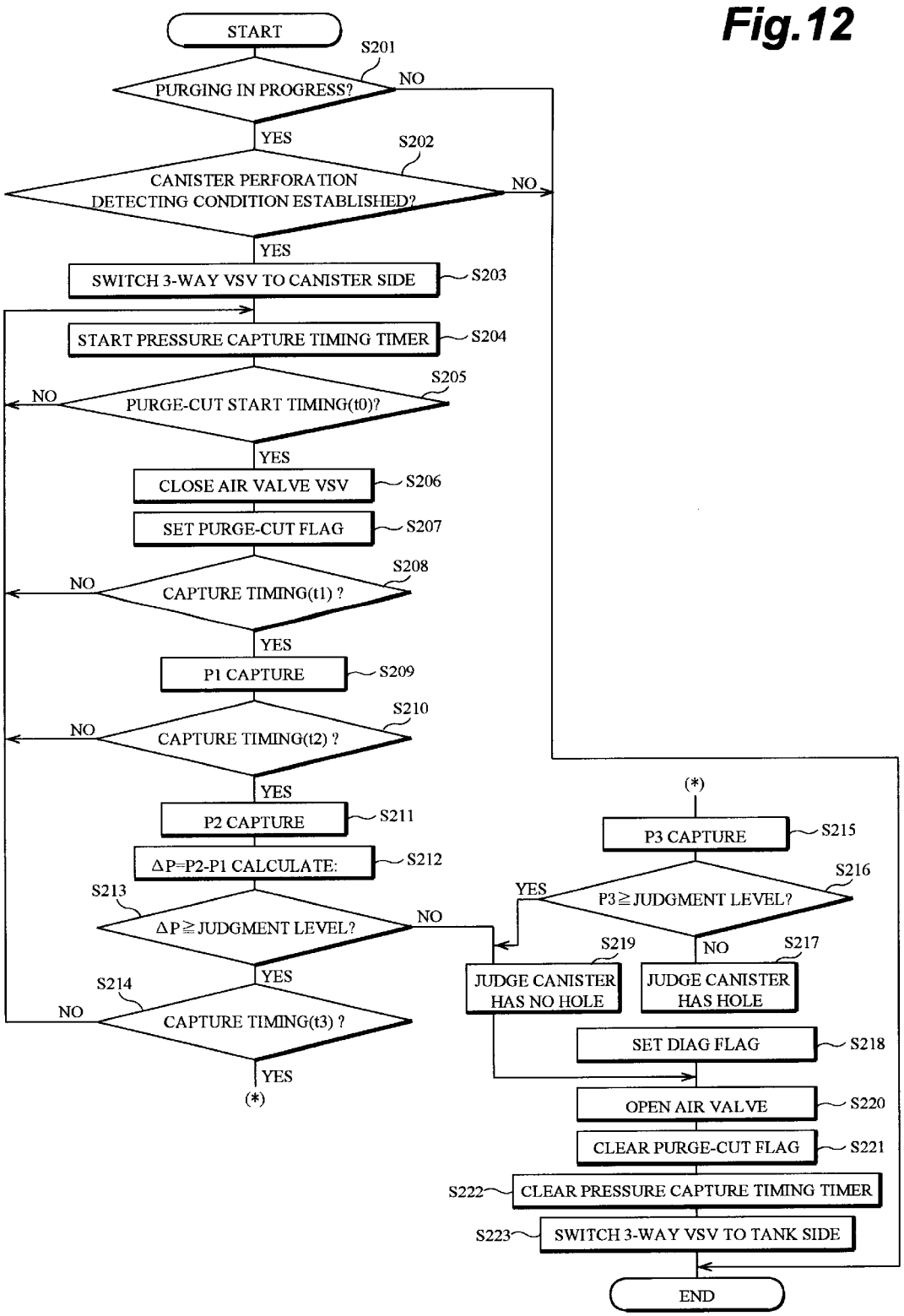
Fig.12
START
S201
PURGING IN PROGRESS?
NO
YES
S202
CANISTER PERFORATION DETECTING CONDITION ESTABLISHED?
NO
YES
SWITCH 3-WAY VSV TO CANISTER SIDE
S203
START PRESSURE CAPTURE TIMING TIMER
S204
S205
NO
PURGE-CUT START TIMING(t0)?
YES
CLOSE AIR VALVE VSV
S206
SET PURGE-CUT FLAG
S207
S208
NO
CAPTURE TIMING(t1) ?
YES
P1 CAPTURE
S209
S210
NO
CAPTURE TIMING(t2) ?
YES
P2 CAPTURE
S211
ΔP=P2-P1 CALCULATE:
S212
S213
ΔP≧JUDGMENT LEVEL?
NO
YES
S214
NO
CAPTURE TIMING(t3) ?
YES
(*)
(*)
P3 CAPTURE
S215
S216
YES
P3≧JUDGMENT LEVEL?
NO
S219
JUDGE CANISTER HAS NO HOLE
S217
JUDGE CANISTER HAS HOLE
SET DIAG FLAG
S218
OPEN AIR VALVE
S220
CLEAR PURGE-CUT FLAG
S221
S222
CLEAR PRESSURE CAPTURE TIMING TIMER
S223
SWITCH 3-WAY VSV TO TANK SIDE
END

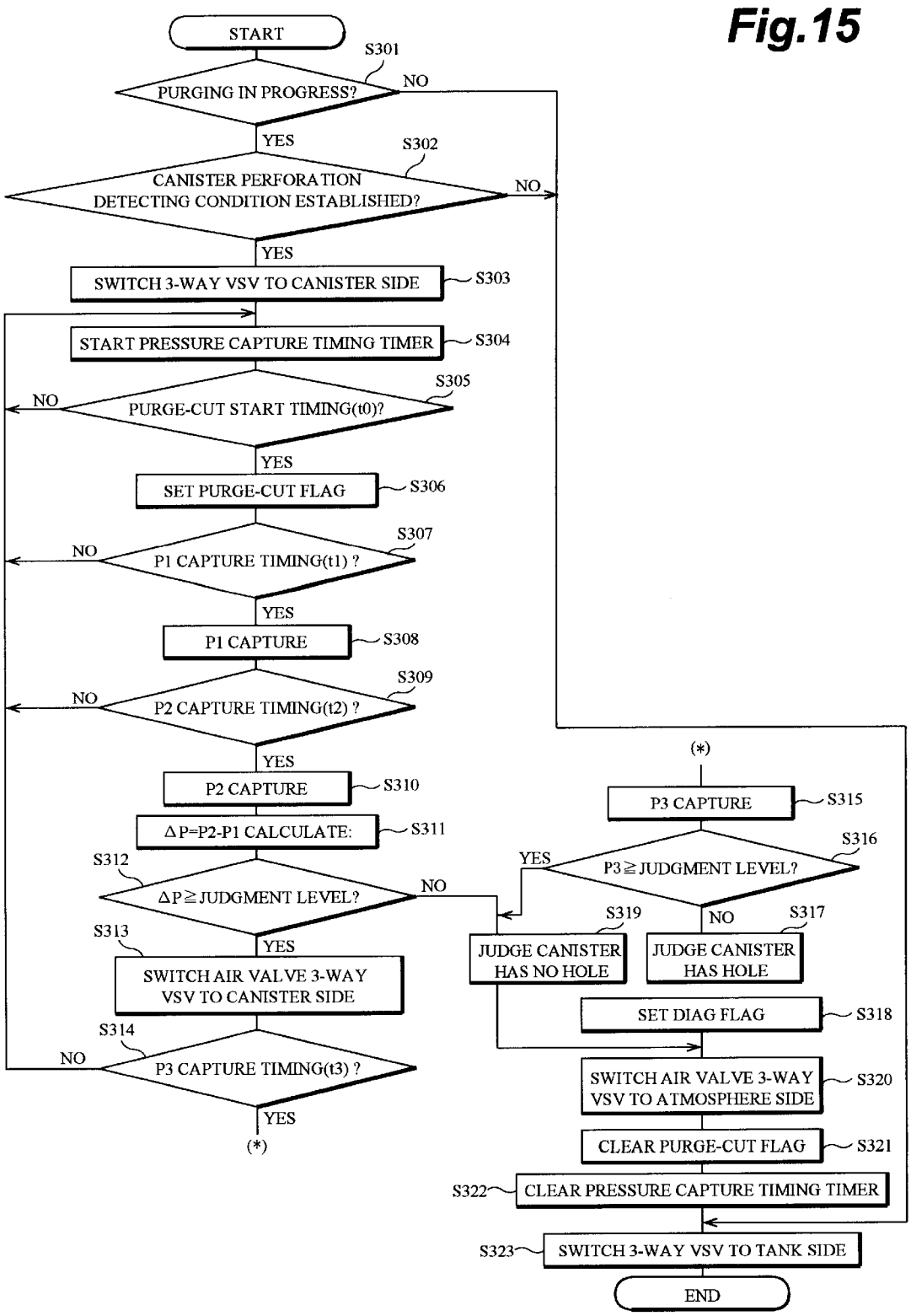
Fig.15
START
S301
PURGING IN PROGRESS?
NO
YES
S302
CANISTER PERFORATION DETECTING CONDITION ESTABLISHED?
NO
YES
SWITCH 3-WAY VSV TO CANISTER SIDE
S303
START PRESSURE CAPTURE TIMING TIMER
S304
S305
NO
PURGE-CUT START TIMING(t0)?
YES
SET PURGE-CUT FLAG
S306
S307
NO
P1 CAPTURE TIMING(t1) ?
YES
P1 CAPTURE
S308
S309
NO
P2 CAPTURE TIMING(t2) ?
YES
P2 CAPTURE
S310
ΔP=P2-P1 CALCULATE:
S311
S312
ΔP≧JUDGMENT LEVEL?
NO
YES
S313
SWITCH AIR VALVE 3-WAY VSV TO CANISTER SIDE
S314
NO
P3 CAPTURE TIMING(t3) ?
YES
(*)
(*)
P3 CAPTURE
S315
S316
YES
P3≧JUDGMENT LEVEL?
NO
S319
S317
JUDGE CANISTER HAS NO HOLE
JUDGE CANISTER HAS HOLE
SET DIAG FLAG
S318
SWITCH AIR VALVE 3-WAY VSV TO ATMOSPHERE SIDE
S320
CLEAR PURGE-CUT FLAG
S321
S322
CLEAR PRESSURE CAPTURE TIMING TIMER
S323
SWITCH 3-WAY VSV TO TANK SIDE
END

PRIOR ART

PRIOR ART

FAILURE DIAGNOSIS APPARATUS FOR EVAPORATIVE PURGE SYSTEM

BACKGROUND OF THE INVENTION

1. Field of the Invention

The present invention relates to a failure diagnosis apparatus for evaporative purge system which diagnoses failures in an evaporative purge system extending from a fuel tank to a purge passage by way of a canister.

2. Related Background Art

Conventional failure diagnosis apparatus for evaporative purge system is disclosed in Japanese Patent Application Laid-Open No. 5-180099. FIG. 20 shows such an apparatus for evaporative purge system.

First, in the diagnosis operation in this apparatus, a second control valve 101 serving as an air release valve is closed so as to shut an air opening of a canister 102, while a first control valve 103 is opened. Consequently, a negative pressure of an intake passage 104 is introduced into an evaporative purge system extending from a purge passage 105 to a fuel tank 107 by way of the canister 102 and an vapor passage 106. Thereafter, under a predetermined condition, the first control valve 103 is closed so as to temporarily cut the purge and, during this period, the pressure behavior within the system extending from the first control valve 103 to the fuel tank 107 is measured. After purge-cutting, the pressure behavior within this system, measured as the canister internal pressure, gradually increases toward the atmospheric pressure. When leakage occurs within the system due to perforation therein, for example, as shown in FIG. 21, pressure change $\Delta P_1$ per predetermined time t is greater than pressure change $\Delta P_0$ in the case where no leakage occurs. By utilizing this phenomenon, the apparatus measures the pressure behavior after the purge-cutting, thereby diagnosing the failure within the subject system.

SUMMARY OF THE INVENTION

In general, when the fuel is highly volatile or the fuel temperature is so high that the fuel is likely to evaporate, a greater amount of vapor (evaporated fuel) is generated in the fuel tank. Under the influence of thus generated vapor, the pressure regulating valve devices within the evaporative purge system may accidentally be opened, whereby diagnosis may not accurately be effected.

Known as an example of such pressure regulating valve devices is a tank internal pressure regulating valve 108 (see FIG. 20) for adjusting the pressure in the fuel tank 107. When an increased amount of vapor is generated, the tank inner pressure regulating valve 108 opens as the internal pressure of the fuel tank 107 increases. Consequently, the vapor within the fuel tank 107 flows toward the canister 102, whereby the pressure within the system during diagnosis rises toward the positive pressure side. As a result, though there is no failure such as perforation, the pressure may change as indicated by $\Delta P_1$ (FIG. 21) as if a failure exists. Accordingly, there are cases where it may erroneously be judged that the failure exists within the system.

Known as another example of the pressure regulating valve devices is the air release valve (second control valve in FIG. 20) for opening the canister 102 to the atmosphere. This kind of valve devices may become problematic when an ORVR (On-Board Refueling Vapor Recovery) system, in which the vapor discharged during refueling is absorbed by the canister, is employed. Namely, in the ORVR system, in order to reduce the resistance to refueling and restrain the evaporative emission during refueling from being discharged, the valve opening pressure of the air release valve is set to a relatively low pressure near the atmospheric pressure. This feature may become problematic upon failure diagnosis as will be explained in the following.

At the time of failure diagnosis, the evaporative purge system is closed, whereby the pressure within this system is increased by the vapor generated in the fuel tank 107. As a result, the pressure within the system is substantially stabilized near the atmospheric pressure when there is perforation or the like within the system being diagnosed, whereas it gradually shifts toward the positive pressure side due to the generated vapor when perforation or the like does not occur (see FIG. 22). Here, in FIG. 22 and FIG. 23, which will be referred to in the following, the canister internal pressure is indicated as how much it deviates from the atmospheric pressure designated as "0."

When the failure diagnosis is effected on the basis of such a pressure behavior, the air release valve opens in the process of increasing the pressure within the system since the valve opening pressure of the air release valve is near the atmospheric pressure. Accordingly, as shown in FIG. 23, there are cases where the canister internal pressure does not rise to a judgment line, whereby it may erroneously be judged that there is leakage within the system being diagnosed.

In order to overcome these problems, it is an object of the present invention to provide a failure diagnosis apparatus for evaporative purge system which can prevent the failure diagnosis from becoming erroneous as pressure regulating valve devices within the evaporative purge system open during the failure diagnosis, whereby the failure diagnosis can be performed more accurately.

The failure diagnosis apparatus for evaporative purge system in accordance with a first aspect of the present invention is a failure diagnosis apparatus for evaporative purge system for diagnosing failure of an evaporative purge system extending from a fuel tank, which is connected to a canister by way of a vapor passage, to a purge passage, which connects the canister to an intake passage of an internal combustion engine. This failure diagnosis apparatus comprises pressure detecting means for detecting a pressure in a predetermined section within the evaporative purge system; judgment means for judging, according to a pressure change detected by the pressure detecting means, whether there is a failure in the predetermined section or not; a pressure regulating valve for adjusting the pressure within the evaporative purge system; and valve opening suppressing means for restraining the pressure regulating valve from opening during the failure diagnosis.

As such a valve opening suppressing means is provided, the pressure regulating valve is restrained from opening during the failure diagnosis. Accordingly, during this period, the pressure in the predetermined section is detected by the pressure detecting means and, based on thus detected pressure, the judgment means judges whether there is a failure or not. Thus, the failure diagnosis is prevented from becoming erroneous as the pressure regulating valve opens during the failure diagnosis, whereby the failure diagnosis can accurately be effected within this system.

In the failure diagnosis system for evaporative purge system in accordance with a second aspect of the present invention, the pressure regulating valve in the first aspect is a tank internal pressure regulating valve having a back-pressure chamber to which a predetermined pressure is applied and a circuit pressure chamber to which the pressure in the fuel tank is applied by way of the vapor passage. This valve is adapted to open when the pressure in the circuit pressure chamber is greater than that of the back-pressure chamber, thereby communicating the fuel tank and the canister to each other. Also, the valve opening suppressing means in the first aspect is constituted as a communicating passage through which the pressure in the canister is introduced into the back-pressure chamber of the tank internal pressure regulating valve.

The effect of such a communicating passage will be explained in detail with reference to FIGS. 1 to 3. Normally, an air intake valve 40 for introducing the air into a canister 11 is provided so as to communicate with the canister 11, and the negative pressure in the canister 11 during purging is controlled by the air intake valve 40 so as to attain a constant level. When the purge is cut from this state (a purge duty VSV is totally closed), the negative pressure in the canister 11 decreases to the valve opening pressure of the air intake valve 40, since this pressure is introduced into a back-pressure chamber 21 of a tank internal pressure regulating valve 20 by way of a communicating passage 53, the pressure acting on the back-pressure chamber 21 exhibits a similar behavior. Accordingly, the pressure applied to the back-pressure chamber 21 during the purge-cutting operation is relatively higher than that during the purging operation, whereby the valve opening pressure of the tank internal pressure regulating valve 20 is set higher during the purge-cutting operation than during the purging operation. Thus, as shown in FIG. 3, even when the pressure in the fuel tank increases due to the vapor generated during the failure diagnosis, the tank internal pressure regulating valve can be restrained from opening.

In the failure diagnosis system for evaporative purge system in accordance with a third aspect of the present invention, the pressure regulating valve in the first aspect is an air release valve having a back-pressure chamber to which a predetermined pressure is applied and a circuit pressure chamber to which the pressure in the canister is applied. This valve is adapted to open when the pressure in the circuit pressure chamber is greater than that of the back-pressure chamber, thereby opening the canister to the atmosphere. Also, the valve opening suppressing means in the first aspect is constituted as set pressure changing means for changing the pressure setting in the back-pressure chamber of the air release valve during the failure diagnosis.

As mentioned above, in the evaporative purge system employing an ORVR system, the valve opening pressure of the air release valve connected to the canister is set to a relatively low level near the atmospheric pressure. Accordingly, the set pressure changing means raises the pressure setting in the back-pressure chamber of the air release valve during the failure diagnosis, thereby restraining the air release valve from opening.

An example of the set pressure changing means is an air valve VSV which closes the back-pressure chamber only at the time of failure diagnosis. Though the back-pressure chamber of the air release valve is normally open to the atmosphere, it constitutes a kind of pressure spring when the back-pressure chamber is closed by the air valve VSV, thereby functioning to substantially raise the valve opening pressure setting. Consequently, when the air valve VSV is closed only at the time of failure diagnosis, the valve opening pressure of the air release valve can be set higher.

Another example of the set pressure changing means is a communicating passage which communicates the back-pressure chamber of the air release valve and the canister to each other at the time of failure diagnosis. In the case where the communicating passage is thus provided, the pressure in the back-pressure chamber of the air release valve increases toward the positive pressure side when the pressure in the canister increases toward the positive pressure side. Accordingly, even when the pressure in the canister increases toward the positive pressure side, the pressure difference with respect to the back-pressure chamber of the air release valve does not change relatively, whereby the air release valve can be restrained from opening.

In the failure diagnosis system for evaporative purge system in accordance with a fourth aspect of the present invention, the pressure regulating valve in the first aspect is an air release valve having a back-pressure chamber to which a predetermined pressure is applied and a circuit pressure chamber to which the pressure in the canister is applied. This valve is adapted to open when the pressure in the circuit pressure chamber is greater than that of the back-pressure chamber, thereby opening the canister to the atmosphere. Also, the valve opening suppressing means in the first aspect comprises a first chamber into which the pressure of the intake passage is introduced, a second chamber into which the atmospheric pressure is introduced, and a movable member which moves in response to the difference in pressure between the first and second chambers so as to raise the valve opening pressure of the air release valve.

During the engine operation, the intake passage is negatively pressurized, whereby a negative pressure is introduced into the first chamber. Accordingly, when the first and second chambers are parted from each other by a diaphragm, for example, and a pressure plate or the like is secured to the diaphragm, the diaphragm and the pressure plate move in response to the difference in pressure between the first and second chambers. When a valve member parting the circuit pressure chamber and the back-pressure chamber in the air release valve from each other is configured so as to be pressed by the movable pressure plate, the valve opening pressure of the air release valve can be raised.

At the time when the engine is stopped, including the time of refueling, the pressure difference between the first and second chambers is nullified, whereby the pressing force of the movable member disappears. Accordingly, during the time when the engine is stopped, the valve opening pressure of the air release valve returns to the initially set pressure, thereby yielding no obstacle to the evaporative purge system employing the ORVR system.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 12 is a flow chart showing processing operations in the failure diagnosis apparatus of FIG. 11, in which (*)—(*) indicates a continuous flow;

FIG. 15 is a flow chart showing processing operations in the failure diagnosis apparatus of FIG. 14, in which (*)—(*) indicates a continuous flow;

DETAILED DESCRIPTION OF THE PREFERRED EMBODIMENTS

Figure 1:
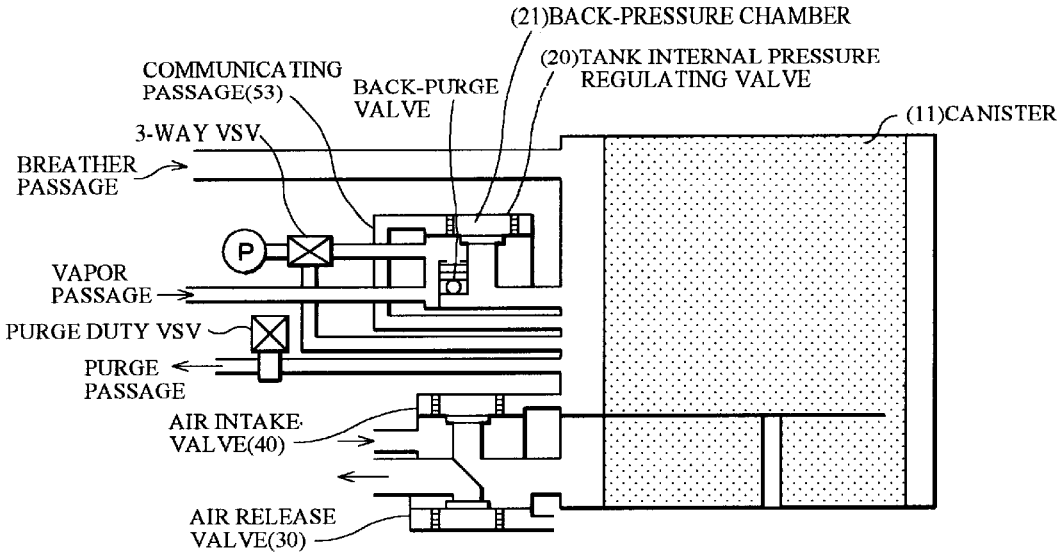
FIG. 1 is a systematic configurational view showing a part of a failure diagnosis system for explaining the principle of operation in the second aspect of the present invention.
Figure 2:
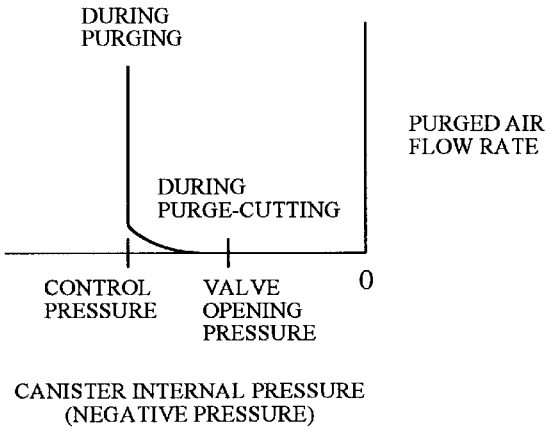
FIG. 2 is a graph showing the relationship between purged air flow rate and canister internal pressure.
Figure 3:
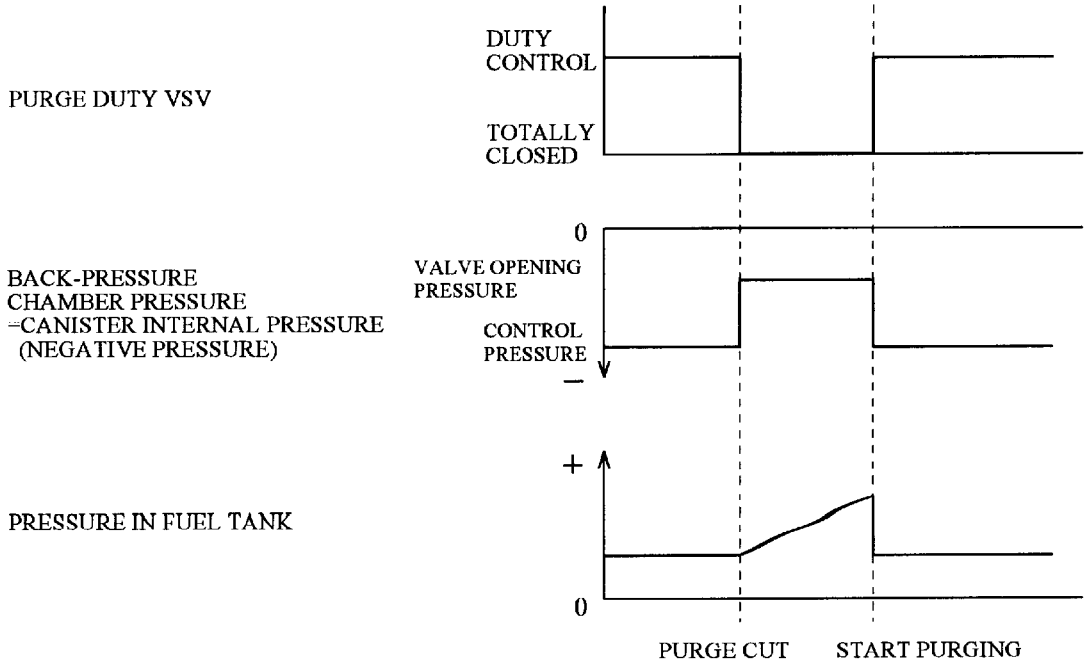
FIG. 3 is a time chart showing operations of a purge duty VSV and their corresponding changes in the back-pressure chamber pressure of the tank internal pressure regulating valve and internal pressure of the fuel tank.
Figure 4:
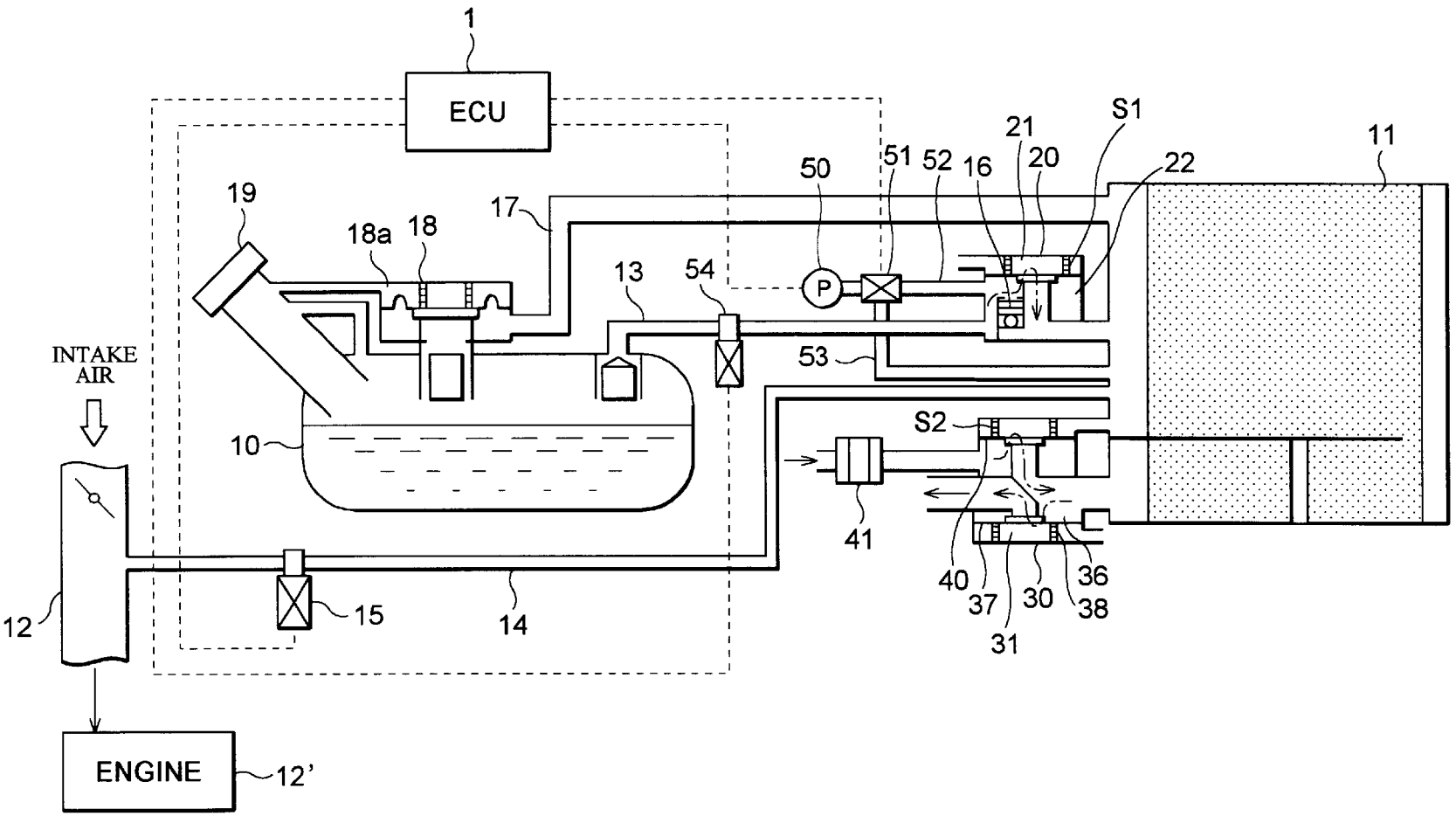
FIG. 4 is a systematic configurational view showing the failure diagnosis apparatus for evaporative purge system in accordance with a first embodiment of the present invention.

FIG. 4 shows an evaporative purge system equipped with the failure diagnosis apparatus in accordance with a first embodiment of the present invention. This evaporative purge system is a system in which vapor (evaporated fuel) generated in a fuel tank 10 is temporarily absorbed by a charcoal canister 11 (referred to as "canister" hereinafter), and a negative pressure generated in an intake passage 12 during engine operation is utilized to separate the absorbed vapor from the canister 11 and introduce thus separated vapor into the intake passage 12. Thus introduced vapor is burned in a combustion chamber of an internal combustion engine 12' connected to the intake passage 12. The fuel tank 10 and the canister 11 are connected to each other by a vapor passage 13, while the canister 11 and the intake passage 12 are connected to each other by a purge passage 14, thereby constituting the evaporative purge system.

The purge passage 14 is provided with an electromagnetic purge duty VSV (Vacuum Switching Valve) 15 which opens and closes in response to an electric signal received from an electronic control unit 1 (referred to as "ECU" hereinafter), thereby duty-controlling the amount of vapor caused to flow into the intake passage 12. For regulating the pressure within the evaporative purge system, the vapor passage 13 is provided with a tank internal pressure regulating valve 20 for opening and closing the vapor passage 13 by a valve operation, functioning to regulate the internal pressure of the fuel tank 10 constituting the evaporative purge system. The tank internal pressure regulating valve 20 comprises a back-pressure chamber 21, to which a predetermined set pressure is applied by a spring force (spring S1) so as to define the valve opening pressure of this valve, and a circuit pressure chamber 22 which communicates with the vapor passage 13 such that the pressure of the latter is applied thereto. This valve 20 is configured so as to open when the internal pressure of the vapor passage 13 increases to the extent that it exceeds the set pressure of the back-pressure chamber 21. Here, the back-pressure chamber 21 is open to the atmosphere. Accordingly, when the internal pressure of the fuel tank 10 and vapor passage 13 becomes greater than the set pressure due to the vapor generated in the fuel tank 10, the tank internal pressure regulating valve 20 opens, whereby the vapor is introduced into the canister 11 from the side of the fuel tank 10. Thus, as the tank internal pressure regulating valve 20 is provided, the vapor generated in the fuel tank 10 is prevented from being absorbed by the canister 11 more than necessary. Here, numeral 16 refers to a back-purge valve for communicating with the vapor passage 13 when the pressure in the fuel tank 10 becomes lower than that on the side of the canister 11 by a predetermined pressure or more. When the fuel temperature in the fuel tank 10 decreases so as to reduce the internal pressure thereof, for example, the back-purge valve 16 opens, thereby controlling the negative pressure in the fuel tank 10 at a predetermined level.

The canister 11 comprises an air release valve 30 which opens when a predetermined positive pressure is attained in the canister 11, thereby opening the canister 11 to the atmosphere, and an air intake valve 40 which opens when a negative pressure is attained in the canister 11 due to purging, thereby causing the atmosphere to flow into the canister 11. Each of these valves functions to regulate the pressure in the evaporative purge system. Here, the air inlet portion of the air intake valve 40 is provided with an air filter 41 for eliminating dust in the intake air. The air intake valve 40 comprises a back-pressure chamber, to which a predetermined set pressure is applied by a spring force (spring S2) so as to define the valve opening pressure of this valve.

The air release valve 30 comprises a back-pressure chamber 31, to which a predetermined set pressure is applied by a spring force so as to define the valve opening pressure of this valve, and a circuit pressure chamber 36 which communicates with the canister 11 such that the pressure of the latter is applied thereto. This valve 30 is configured so as to open when the internal pressure of the vapor passage 11 increases to the extent that the pressure in the circuit pressure chamber 36 exceeds the set pressure of the back-pressure chamber 31. Namely, the back-pressure chamber 31 and the circuit pressure chamber 36 are parted from each other by a diaphragm 37, which is pressed by a spring 38 in the back-pressure chamber 31. When the pressure in the circuit pressure chamber 36 exceeds the pressure of the spring 38, the diaphragm 37 is deformed by the pressure in the circuit pressure chamber 36, whereby the circuit pressure chamber 36 communicates with the atmosphere.

Also, this evaporative purge system employs an ORVR (On-Board Refueling Vapor Recovery) system in which the vapor discharged at the time of refueling is absorbed by the canister 11. Accordingly, the fuel tank 10 and the canister 11 are connected to each other by a breather passage 17. The breather passage 17 is provided with a differential pressure regulating valve 18 which opens when the pressure in the fuel tank 10 is greater than that in its back-pressure chamber 18*a* communicating with a fuel inlet. When a tank cap 19 is opened at the time of refueling, the back-pressure chamber 18*a* of the differential pressure regulating valve 18 attains the atmospheric state, whereby the fuel tank 10 is pressurized by a refueling pressure to a level higher than the atmospheric pressure. Due to this pressure difference, the differential pressure regulating valve 18 opens, whereby the vapor retained in the fuel tank 10 is introduced into the canister 11 by way of the breather passage 17. At this time, the air release valve 30 opens in a manner similar to the differential pressure regulating valve 18.

In order to diagnose failures of thus configured evaporative purge system, provided is a pressure sensor 50 for detecting the pressure in the system. This pressure sensor 50 is connected to a fixed port of a three-way VSV 51. Of the remaining two ports, one is connected to the vapor passage 13 by way of a passage 52, whereas the other is connected to the canister 11 by way of a passage 53. Consequently, upon switching operations of the three-way VSV 51, the pressure sensor 50 can detect the pressure in the system on either side of the tank internal pressure regulating valve 20, i.e., on the side of the fuel tank 10 or the side of the canister 11. Also, the vapor passage 13 between the tank internal pressure regulating valve 16 and the fuel tank 10 is provided with a vapor-cut VSV 54 which closes during failure diagnosis so as to block the vapor passage 13.

The pressure sensor 50, three-way VSV 51, vapor-cut VSV 54, and purge duty VSV 15 are connected to the ECU 1. While the pressure signal from the pressure sensor 50 is supplied to the ECU 1, the switching operations of the three-way VSV 51 and the valve opening and closing operations of the vapor-cut VSV 54 are performed under the control of the ECU 1.

The operations of thus configured evaporative purge system will schematically be explained. When the internal combustion engine is started, and then a predetermined purge condition (e.g., detection of completion of the engine warmup or detection of a predetermined amount of engine load or higher) is established, the purge duty VSV 15 is actuated under the control of the ECU 1, thereby purging the vapor absorbed by the canister 11. When the purge duty VSV 15 opens, the negative pressure in the intake passage 12 is introduced into the canister 11 by way of the purge passage 14. Consequently, the air intake valve 40 opens, whereby the air transmitted through the air filter 41 is introduced into the canister 11. The air transmitted through the canister 11 purges the vapor absorbed in the canister 11 and then is introduced into the intake passage 12. The canister internal pressure during purging becomes negative since the air release valve 30 closes, and is controlled at a constant level by the air intake valve 40. Also, the ECU 1 controls the opening and closing operations of the purge duty VSV 15 such that the influence of purge gas upon the exhaust emission is minimized. As such a series of operations are repeatedly performed, the vapor is prevented from being released into the atmosphere, and the canister 11 is kept from overflowing.

Figure 5:
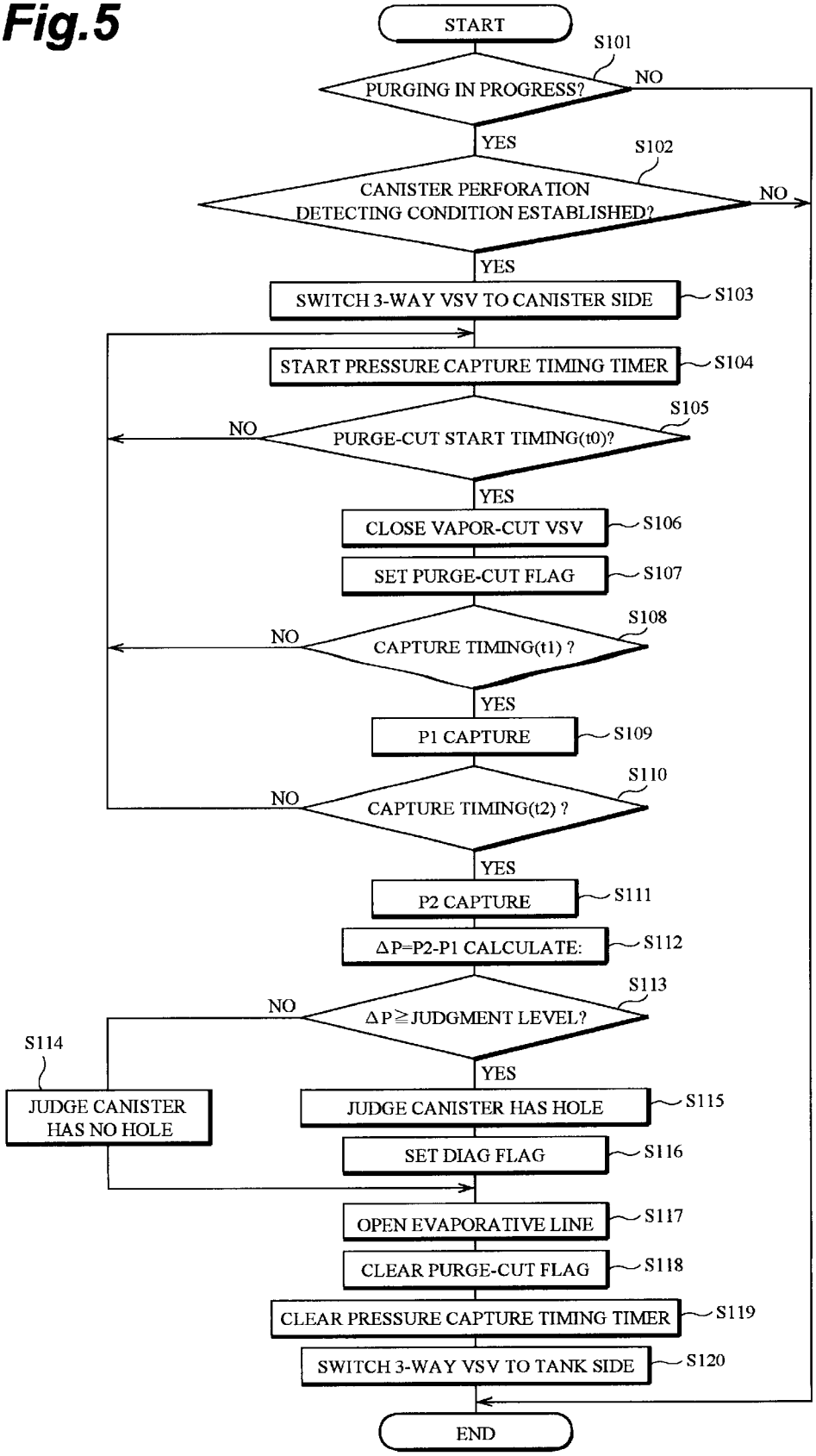
FIG. 5 is a flow chart showing a processing operation in the failure diagnosis apparatus of FIG. 4.
Figure 6:
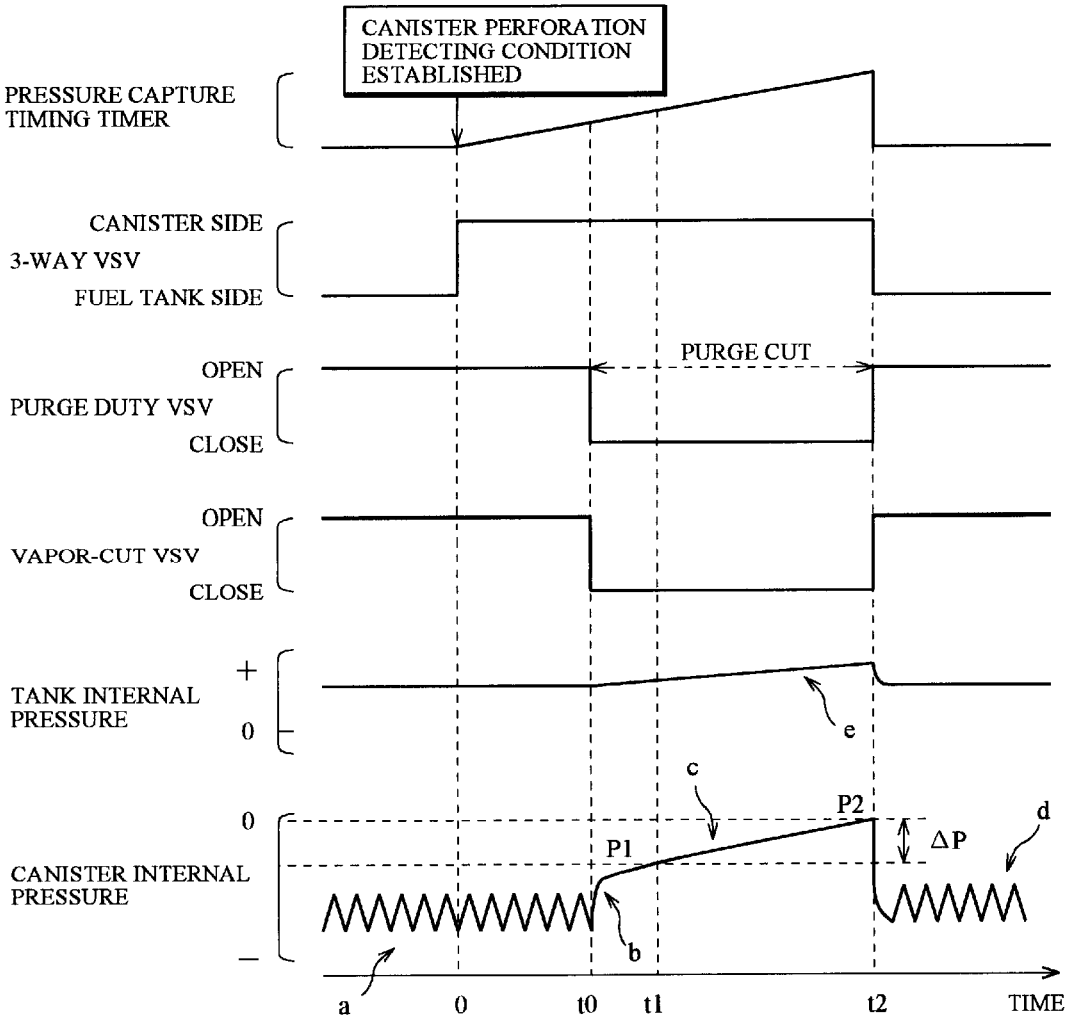
FIG. 6 is a time chart corresponding to FIG. 5 and showing operations of respective valves and their corresponding pressure behaviors in the system.

The processing operation of such a failure diagnosis apparatus for evaporative purge system will be explained with reference to the flow chart of FIG. 5 and FIG. 6 which shows operations of respective valves and their corresponding pressure behaviors in the system.

This processing operation is a routine processing which is performed, for example, at every predetermined time in the ECU 1. When this processing operation is actuated, first, whether purging is being effected or not is judged at step (referred to as "S" hereinafter) 101. This failure diagnosis utilizes the negative pressure introduced into the evaporative purge system upon purging. Accordingly, the failure diagnosis is not performed when no purging is effected (when it is judged "No" at S101), thereby terminating this routine. When purging is being effected (it is judged "Yes" at S101), by contrast, the negative pressure is introduced into this system, whereby the canister internal pressure is pulsating under the influence of the opening and closing operations of the purge duty VSV 15 (see arrow a in FIG. 6).

Subsequently, at S102, it is judged whether or not a condition for detecting perforation of the canister 11 is established. Namely, it is judged whether or not a stable negative pressure is obtained in the canister 11. For example, in the cases (1) where the duty cycle of the purge duty VSV 15 is not lower than a predetermined level (%), (2) where the learned level of the purged vapor concentration is not higher than a predetermined level, or the like, it is judged that the canister perforation detecting condition is established. In the former case (1), the canister negative pressure cannot sufficiently increase in the state where the duty cycle is low, for example, immediately after purging is started, whereby the condition defined in (1) is judged. On the other hand, the gist of judgment in the latter case (2) lies in that leakage check is performed after the canister 11 is vacated to a certain extent, in view of the fact that, in the case where a large amount of vapor is absorbed by the canister 11, the released vapor prevents the negative pressure in the canister 11 from sufficiently increasing even when the negative pressure of the intake passage 12 is introduced into the canister 11. Here, the learned level of purged vapor concentration is the amount of purged vapor estimated from the amount of deterioration in exhaust A/F with respect to a change in purge amount. When it is judged at S102 that the perforation detecting condition for the canister 11 is not established ("No" at S102), there is a possibility that failure diagnosis may not accurately be performed, whereby the routine is terminated without diagnosis.

When it is judged at S102 that the perforation detecting condition for the canister 11 is established ("Yes" at S102), by contrast, the three-way VSV 51 is switched from the fuel tank side to the canister side (S103), such that the pressure on the side of the canister 11 can be detected by the pressure sensor 50. Also, addition of a counted level in a pressure capture timing timer (referred to as "timing timer" hereinafter) is started (S104). The timing timer is a timer for clocking a timing at which the level detected by the pressure sensor 50 is taken into the ECU 1.

Subsequently, at S105, it is judged whether the counted level of the timing timer has reached t0 or not. When the counted level is earlier than t0 ("No" at S105), the processing actions of S104 and S105 are repeated. If the pressure detection is performed immediately after the three-way VSV 51 is switched to the canister side, the pressure between the three-way VSV 51 and the pressure sensor 50 will become unstable and there will be a possibility that stable pressure behavior may not be obtained at the time of leakage check as failure diagnosis. Therefore, in order to more correctly detect the pressure on the canister side, the pressure on the side of the canister 11 is monitored for a predetermined duration of time.

At the time when the counted level of the timing timer reaches t0 ("Yes" at S105), an actual failure diagnosis operation is started. First, at S106, the vapor-cut VSV 54 is closed, whereby the vapor passage 13 communicating the fuel tank 10 to the canister 11 is forcibly blocked. Accordingly, even when the internal pressure of the fuel tank 10 gradually increases (see arrow e in FIG. 6) due to the vapor generated during the failure diagnosis on the side of the canister 11 bounded by the tank internal pressure regulating valve 20, the vapor can be blocked from flowing from the fuel tank 10 toward the canister 11.

Also, when the purge-cut flag, indicating that purge cutting is in progress, is set to "1" (S107), for example, the purge duty VSV 15 is closed under the control of the ECU 1, thereby cutting the purge. Due to this purge cutting operation, the internal pressure of the canister 11 instantly rises to the valve opening negative pressure of the air intake valve 40, thereby closing the latter (see arrow b in FIG. 6). Here, since the air intake valve 40 or the like does not have a completely sealed structure, the internal pressure of the canister 11 gradually increases toward the positive pressure side (see arrow c in FIG. 6) due to leakage from the air intake valve 40 or leakage from a hole when there is perforation.

Then, at S108, it is judged whether the counted level of the timing timer has reached capture timing t1 or not. When the counted level is earlier than the capture timing t1 ("No" at S108), the processing actions of S104 and later are repeated. At the time when the counted level of the timing timer reaches the capture timing t1 ("Yes" at S108), the pressure signal detected by the pressure sensor 50 is captured, and thus captured level is stored in a RAM within the ECU 1 as P1 (S109). Subsequently, at S110, it is judged whether the counted level of the timing timer has reached capture timing t2 or not. When the counted level is earlier than the capture timing t2 ("No" at S110), the processing actions of S104 and later are repeated. At the time when the counted level of the timing timer reaches the capture timing t2 ("Yes" at S110), the pressure signal detected by the pressure sensor 50 is captured, and thus captured level is stored in the RAM within the ECU 1 as P2 (S111).

Subsequently, at S112, P1 and P2 are read out from the RAM, and the pressure difference between P1 and P2, $\Delta P = P1 - P2$, is computed. As explained above, $\Delta P$ becomes greater in the case where leakage is generated in the system due to perforation than in the case where no leakage is generated. Accordingly, the level of $\Delta P$ is compared with a predetermined judgment level (S113). Consequently, when the level of $\Delta P$ is not smaller than the judgment level, it is judged that perforation is generated in the canister 11 (S115), and a diagnosis flag is set (S116). When the diagnosis flag is set, the ECU 1 executes a processing action such as lighting of an alarm lamp indicating that a failure has occurred, so as to inform an operator of the generation of failure. When the level of $\Delta P$ is smaller than the judgment level at S113 ("No" at S113), by contrast, it is judged that no perforation is generated in the canister 11.

When such a series of judgment operations are completed, the vapor-cut VSV 54 closed upon failure diagnosis is reopened (S117), and the purge-cut flag is cleared (set to "0"; S118). When the purge-cut flag is cleared, the purge duty VSV 15 is opened under the control of the ECU 1, whereby the purge control operation is resumed (see arrow d in FIG. 6). Simultaneously, the counted level of the timing timer is cleared (S119) so as to be ready for the next failure diagnosis operation. Further, the three-way VSV 51 is switched from the canister side to the fuel tank side such that the pressure sensor 50 can detect the pressure on the side of the fuel tank 10 (S120), thereby terminating this flow.

When the failure diagnosis apparatus for evaporative purge system is configured in this manner, the vapor can be blocked from flowing from the fuel tank 10 toward the canister 11 during the failure diagnosis on the side of the canister 11, whereby the failure on the side of the canister 11 can be diagnosed more accurately. Also, the fuel tank 10 attains a sealed state when the vapor-cut VSV 54 is closed. Accordingly, as the pressure sensor 50 monitors the pressure behavior in the fuel tank 10, whether or not there is perforation on the side of the fuel tank 10 can be diagnosed more accurately, and even a minute hole can sufficiently be detected.

Figure 7:
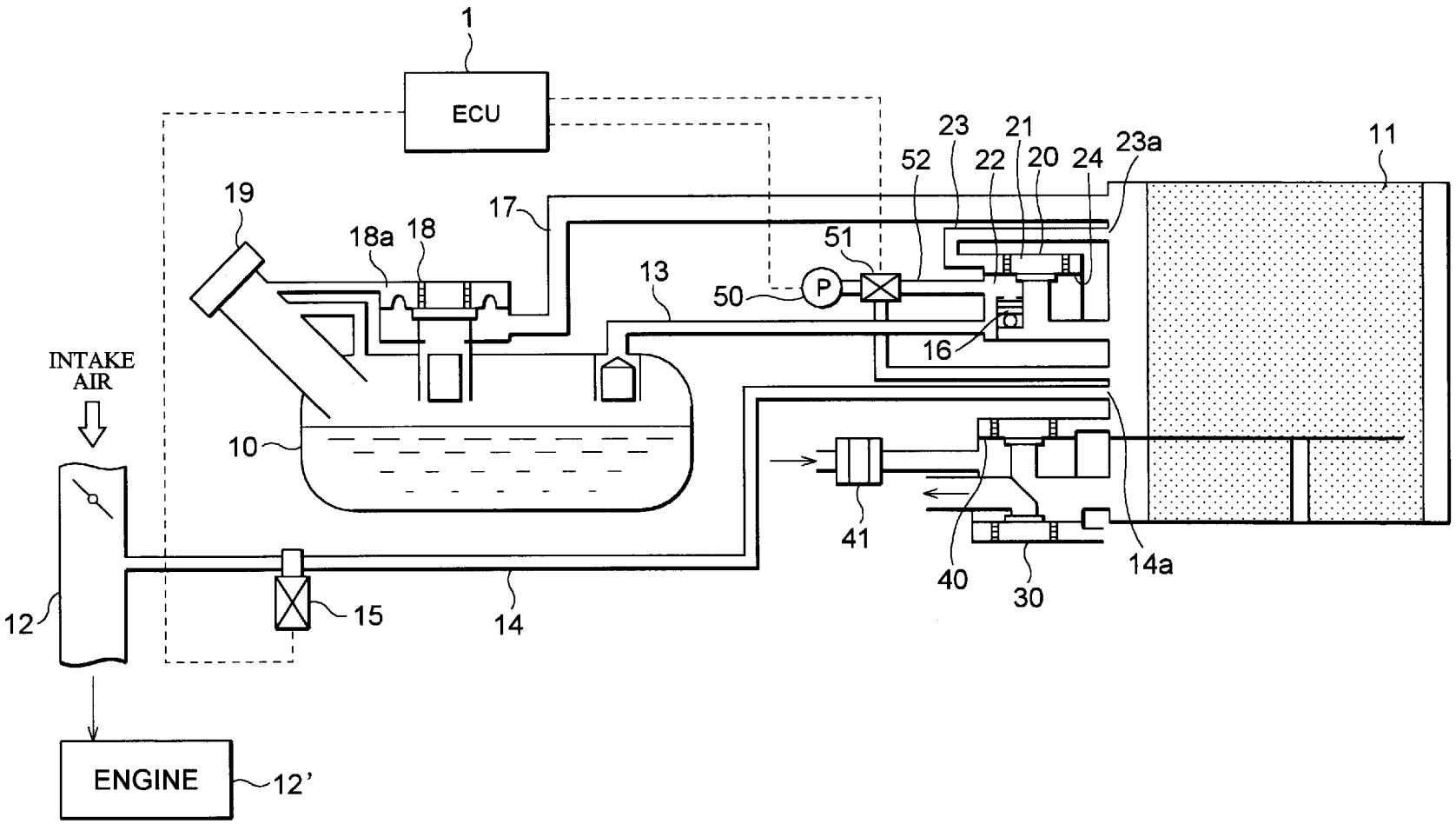
FIG. 7 is a systematic configurational view showing the failure diagnosis apparatus for evaporative purge system in accordance with a second embodiment of the present invention.

FIG. 7 shows an evaporative purge system equipped with the failure diagnosis apparatus in accordance with a second embodiment. Here, constituents identical to those in FIG. 4 are referred to with marks identical thereto.

In this embodiment, without the vapor-cut VSV 54 used in the first embodiment, while the back-pressure chamber 21 of the tank internal pressure regulating valve 20 is not made open to the atmosphere, the back-pressure chamber 21 and the canister 11 are connected to each other by a communicating passage 23. Also in such a configuration, the vapor can be blocked from flowing from the fuel tank 10 into the canister 11 during purge cutting at the time of failure diagnosis.

Figure 8:
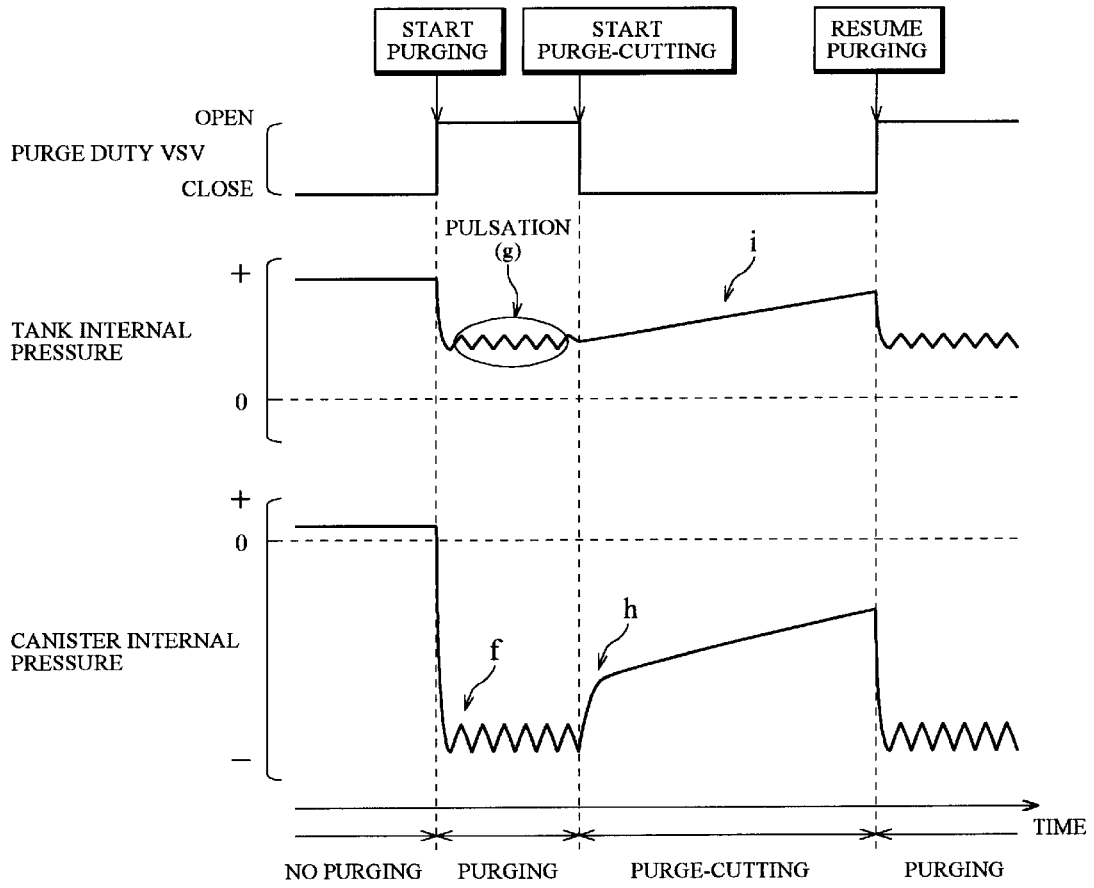
FIG. 8 is a time chart showing operations of a purge duty VSV in the failure diagnosis apparatus of FIG. 7 and their corresponding changes in the back-pressure chamber pressure of the tank internal pressure regulating valve and internal pressure of the fuel tank.

Here, the principle of this blocking operation will be explained. First, in the region where no purging is effected at the time when the engine is stopped or after the engine is started, the internal pressure of the canister 11 is stable between the positive set pressure defined by the air release valve 30 and the valve opening pressure of the air intake valve 40. This state depends on the internal pressure of the fuel tank 10. FIG. 8 exemplifies a case where the internal pressure of the fuel tank 10 is controlled by a positive set pressure.

When the purge duty VSV 15, which has been closed, is opened so as to start purging, the negative pressure in the intake passage 12 is introduced into the evaporative purge system extending from the purge passage 14 to the fuel tank 10 by way of the canister 11 and vapor passage 13. Accordingly, the internal pressure of the canister 11 and the internal pressure of the fuel tank 10 shift as respectively indicated by arrows f and g in FIG. 8. During purging, the canister internal pressure pulsates under the influence of the opening and closing operations of the purge duty VSV 15. Following this pressure fluctuation, the setting of the valve opening pressure of the tank internal pressure regulating valve 20 pulsates as well.

Figure 9:
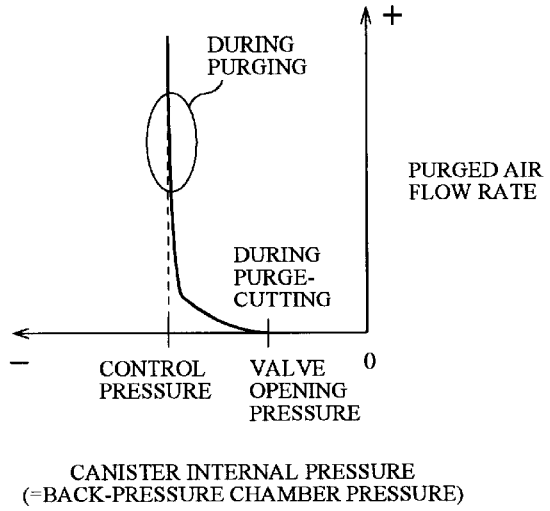
FIG. 9 is a graph showing the relationship between purged air flow rate and canister internal pressure.

As the negative pressure in the canister 11 increases in this manner, this negative pressure is under the control of the control pressure of the air intake valve 40 as shown in FIG. 9. The negative pressure is introduced into the back-pressure chamber 21 of the tank internal pressure regulating valve 20 by way of the communicating passage 23. Since the negative pressure acts so as to lift a diaphragm 24 of the tank internal pressure regulating valve 20 toward the back-pressure chamber 21, the valve opening pressure setting of the tank internal pressure regulating valve 20 is lowered due to this action.

Subsequently, when the purge duty VSV 15 is closed so as to start purge-cutting, the internal pressure of the canister 11 instantly rises (negative pressure decreases) toward the positive pressure side to the valve opening pressure of the air intake valve 40 as indicated by FIG. 9 and arrow h in FIG. 8. Accordingly, the pressure introduced into the back-pressure chamber 21 also rises toward the positive pressure side, whereby the valve opening pressure setting of the tank internal pressure regulating valve 20 rises by an amount corresponding thereto. Though the internal pressure of the fuel tank 10 gradually increases (see arrow i in FIG. 8) during this period due to the vapor generated therein, the closed state of the tank internal pressure regulating valve is maintained since the valve opening pressure of the tank internal pressure regulating valve 20 is set higher. Accordingly, during this period, the vapor is temporarily blocked from flowing from the fuel tank 10 into the canister 11. Thus, when the failure diagnosis on the side of the canister 11 is effected during this period, the failure can be diagnosed in the state where the influence of vapor generated in the fuel tank 10 is eliminated.

Figure 10:
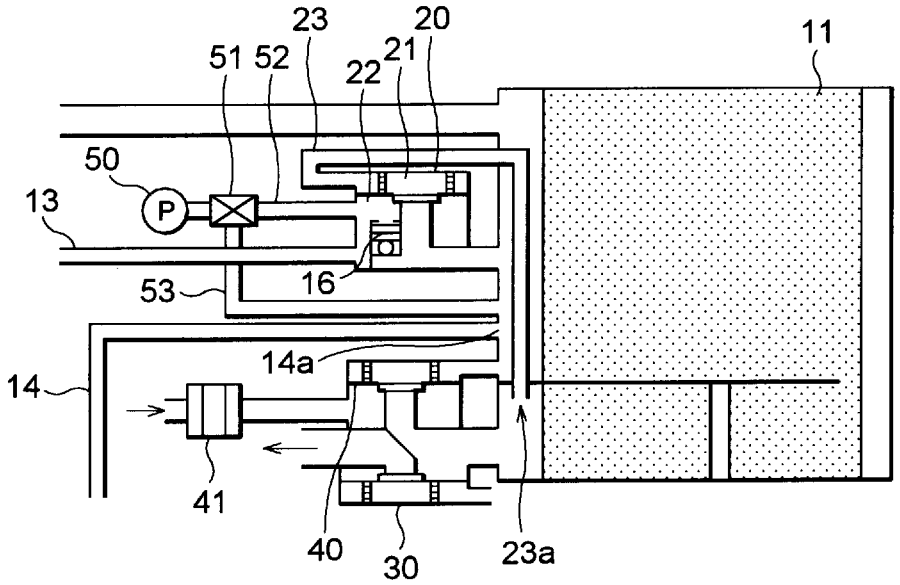
FIG. 10 is a systematic configurational view showing a part of the failure diagnosis apparatus for evaporative purge system in accordance with a third embodiment of the present invention.

FIG. 10 shows a third embodiment in which a part of the failure diagnosis apparatus shown in FIG. 7 is improved. While the back-pressure chamber 21 of the tank internal pressure regulating valve 20 and the canister 11 are connected to each other by the communicating passage 23 in this embodiment as well, an opening end 23*a* of the communicating passage 23 is placed in a space within the canister 11 near the air release valve 30 and the air intake valve 40. Since it is disposed at this position, as compared with the communicating passage 23 shown in FIG. 7, the pressure introduced into the back-pressure chamber 21 is restrained from fluctuating. While the negative pressure is introduced by way of the purge passage 14 as mentioned above, since the opening end 23*a* of the communicating passage 23 in FIG. 7 and an opening end 14*a* of the purge passage 14 are positioned in the same space before the pressure is transmitted through the canister 11, the pressure fluctuation of the negative pressure introduced by way of the purge passage 14 is directly fed into the back-pressure chamber 21. By contrast, in the communicating passage 23 shown in FIG. 10, since its opening end 23*a* and the opening end 14*a* of the purge passage 14 are connected to each other by way of the canister 11, the pulsation in pressure appearing at the opening end 14*a* of the purge passage 14 is attenuated as transmitted through the canister 11, which functions as a resistance. Accordingly, the negative pressure introduced into the back-pressure chamber 21 fluctuates less than that in the case of FIG. 7. Consequently, members constituting the tank internal pressure regulating valve 20 such as diaphragm and spring can have a wider range of tolerance with respect to durability and strength required therefor.

The first to third embodiments explained in the foregoing exemplify the cases where the vapor is blocked (stopped) from flowing from the fuel tank 10 into the canister 11 even when the vapor generated in the fuel tank 10 increases, whereby the failure diagnosis is performed in the state where the influence of the flowing vapor is eliminated.

Figure 11:
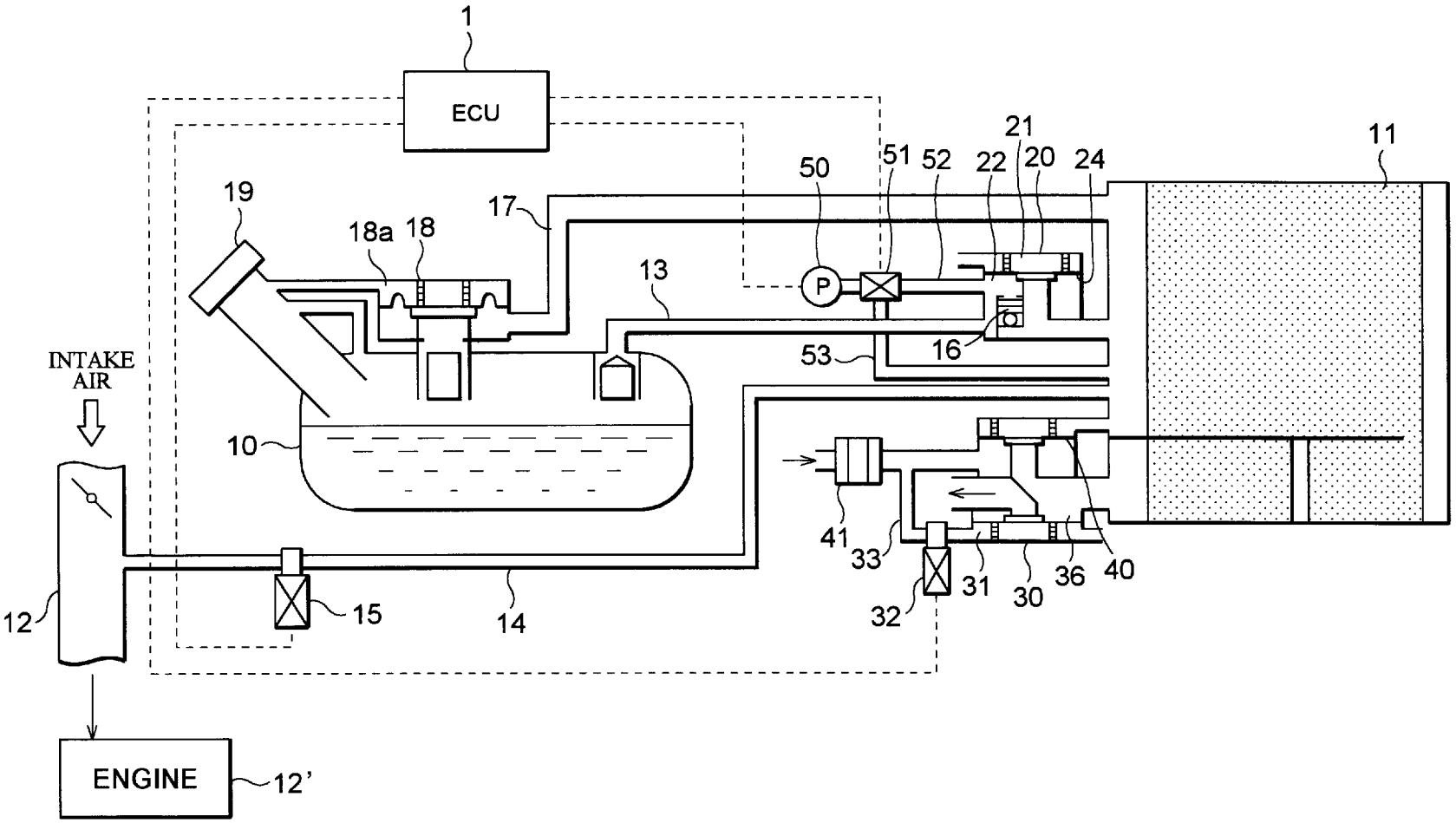
FIG. 11 is a systematic configurational view showing the failure diagnosis apparatus for evaporative purge system in accordance with a fourth embodiment of the present invention.

FIG. 11 shows an evaporative purge system equipped with the failure diagnosis apparatus in accordance with a fourth embodiment. Here, constituents identical to those in FIG. 4 are referred to with marks identical thereto. In this embodiment, an air valve VSV 32 is connected to the atmosphere side of the back-pressure chamber 31 in the air release valve 30, whereas the atmosphere side of the air valve VSV 32 is connected to the downstream of the air filter 41 by a communicating passage 33 so as to prevent foreign matters from entering the VSV. The opening and closing operations of the air valve VSV 32 are controlled by the ECU 1. In such a configuration, as the air valve VSV 32 is closed at the time of failure diagnosis so as to seal the back-pressure chamber 31, the valve opening pressure setting of the air release valve 30 can be raised.

Figure 13:
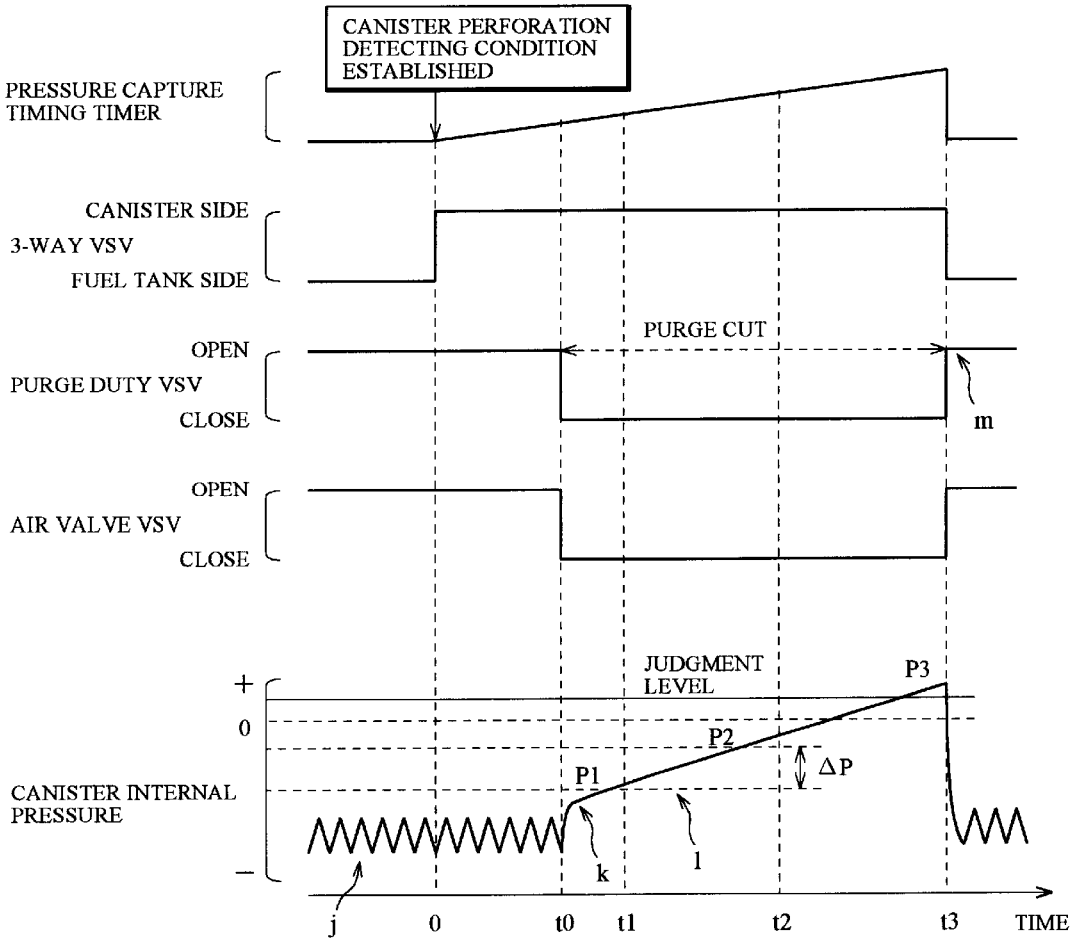
FIG. 13 is a time chart corresponding to FIG. 11 and showing operations of respective valves and their corresponding pressure behaviors in the system.

The processing operation of such a failure diagnosis apparatus for evaporative purge system will be explained with reference to the flow chart of FIG. 12 and FIG. 13 which shows operations of respective valves and their corresponding pressure behaviors in the system.

First, whether purging is being effected or not is judged at S201. This failure diagnosis utilizes the negative pressure introduced into the evaporative purge system upon purging. Accordingly, the failure diagnosis is not performed when no purging is effected (when it is judged "No" at S201), thereby terminating this routine. When purging is being effected (it is judged "Yes" at S201), by contrast, the negative pressure is introduced into this system, whereby the internal pressure of the canister is pulsating under the influence of the opening and closing operations of the purge duty VSV 15 (see arrow j in FIG. 13).

Subsequently, at S202, it is judged whether or not a condition for detecting perforation of the canister 11 is established. This condition is similar to that exemplified at S102 in FIG. 5. When it is judged at S202 that the perforation detecting condition for the canister 11 is not established ("No" at S202), there is a possibility that failure diagnosis may not accurately be performed, whereby the routine is ended without diagnosis.

When it is judged at S202 that the perforation detecting condition for the canister 11 is established ("Yes" at S202), by contrast, the three-way VSV 51 is switched from the fuel tank side to the canister side (S203), such that the pressure on the side of the canister 11 can be detected by the pressure sensor 50. Also, addition of a counted level in the timing timer is started (S204).

Subsequently, at S205, it is judged whether the counted level of the timing timer has reached t0 or not. When the counted level is earlier than t0 ("No" at S205), the processing actions of S204 and S205 are repeated. In order to stabilize the pressure between the three-way valve 51 and the pressure sensor 50 and to more correctly detect the pressure on the canister side, the pressure on the side of the canister 11 is monitored for a predetermined duration of time.

At the time when the counted level of the timing timer reaches t0 ("Yes" at s205), the ECU 1 causes the air valve VSV 32 to close (S206). Consequently, the back-pressure chamber 31 of the air release valve 30 is sealed so as to function as a kind of pressure spring, whereby the valve opening pressure of the air release valve 30 is set higher than that when it is open to the atmosphere.

Also, when the purge-cut flag, indicating that purge cutting is in progress, is set to "1" (S207), for example, the purge duty VSV 15 is closed under the control of the ECU 1, thereby cutting the purge. Due to this purge cutting operation, the internal pressure of the canister 11 instantly rises to the valve opening negative pressure of the air intake valve 40, thereby closing the air intake valve 40 (see arrow k in FIG. 13). Here, since the air intake valve 40 or the like does not have a completely sealed structure, the internal pressure of the canister 11 gradually increases toward the positive pressure side (see arrow 1 in FIG. 13) due to leakage from the air intake valve 40 or leakage from a hole when there is perforation. In this case, as will be explained later, even when the purge-cutting operation is continued such that the circuit pressure chamber 36 communicating with the canister 11 shifts to the positive pressure, since the valve opening pressure setting is raised at S206, the air release valve 30 does not open.

Then, at S208, it is judged whether the counted level of the timing timer has reached capture timing t1 or not. When the counted level is earlier than the capture timing t1 ("No" at S208), the processing actions of S204 and later are repeated. At the time when the counted level of the timing timer reaches the capture timing t1 ("Yes" at S208), the pressure signal detected by the pressure sensor 50 is captured, and thus captured level is stored in a RAM within the ECU 1 as P1 (S209). Subsequently, at S210, it is judged whether the counted level of the timing timer has reached capture timing t2 or not. When the counted level is earlier than the capture timing t2 ("No" at S210), the processing actions of S204 and later are repeated. At the time when the counted level of the timing timer reaches the capture timing t2 ("Yes" at S210), the pressure signal detected by the pressure sensor 50 is captured, and thus captured level is stored in the RAM within the ECU 1 as P2 (S211).

Subsequently, at S212, P1 and P2 are read out from the RAM, and the pressure difference between P1 and P2, $\Delta P = P1 - P2$, is computed. $\Delta P$ becomes greater in the case where leakage is generated in the system due to perforation than in the case where no leakage is generated. Accordingly, the level of $\Delta P$ is compared with a predetermined judgment level (S213). Consequently, when the level of $\Delta P$ is smaller than the judgment level ("No" at S213), it is judged that perforation is not generated in the canister 11 (S219), whereby the flow shifts to the processing actions of S220 and later, which will be explained later.

When the level of $\Delta P$ is not smaller than the judgment level ("Yes" at S213), by contrast, there is a possibility that misjudgment may be made under the influence of the vapor flowing from the fuel tank 10. The internal pressure of the canister 11 rises to the positive pressure in the case of misjudgment, whereas it is stabilized near the atmospheric pressure in the case where perforation is generated. In order to distinguish these cases from each other, the purge-cutting operation is further continued. Namely, at S214, the counted level of the timing timer is captured, and it is judged whether or not thus captured level has reached capture timing t3 or not. When the counted level is earlier than the capture timing t3 ("No" at S214), the processing actions of S204 and later are repeated.

At the time when the counted level of the timing timer reaches the capture timing t3 ("Yes" at S214), the pressure signal detected by the pressure sensor 50 is captured, and thus captured level is stored in the RAM within the ECU 1 as P3 (S215).

Subsequently, at S216, P3 is read out from the RAM and is compared with a predetermined judgment level (positive pressure level; see FIG. 13). When the level of P3 is smaller than the judgment level ("No" at S216), i.e., when the internal pressure of the canister 11 is stabilized near the atmospheric pressure, it is judged that perforation is generated in the canister 11 (S217), and a diagnosis flag is set (S218). When the diagnosis flag is set, the ECU 1 executes a processing action such as lighting of an alarm lamp indicating that a failure has occurred, so as to inform the operator of the generation of failure. When the level of P3 is not smaller than the judgment level ("Yes" at S216), since it can be judged that the increase in pressure is due to the influence of the vapor generated in the fuel tank 10, it is judged that no failure such as perforation is generated in the canister 11 (S219).

When such a series of judgment operations in failure diagnosis are completed, the air valve VSV 32 closed upon the failure diagnosis is reopened (S220), and the purge-cut flag is cleared (set to "0"; S221). When the purge-cut flag is cleared, the purge duty VSV 15 is opened under the control of the ECU 1, whereby the purge control operation is resumed (see arrow m in FIG. 13). Also, the counted level of the timing timer is cleared (S222) so as to be ready for the next failure diagnosis operation. Further, the three-way VSV 51 is switched from the canister side to the fuel tank side such that the pressure sensor 50 can detect the pressure on the side of the fuel tank 10 (S223), thereby terminating this flow.

When the failure diagnosis apparatus for evaporative purge system is configured in this manner, the air release valve 30 can be restrained from opening during the failure diagnosis. Accordingly, even in an evaporative purge system employing an ORVR system, the internal pressure of the canister 11 can sufficiently be raised to the positive pressure, whereby an accurate result of diagnosis can securely be obtained. Also, since the air valve VSV 32 closes only at the time of failure diagnosis, it does not affect the resistance upon refueling.

Figure 14:
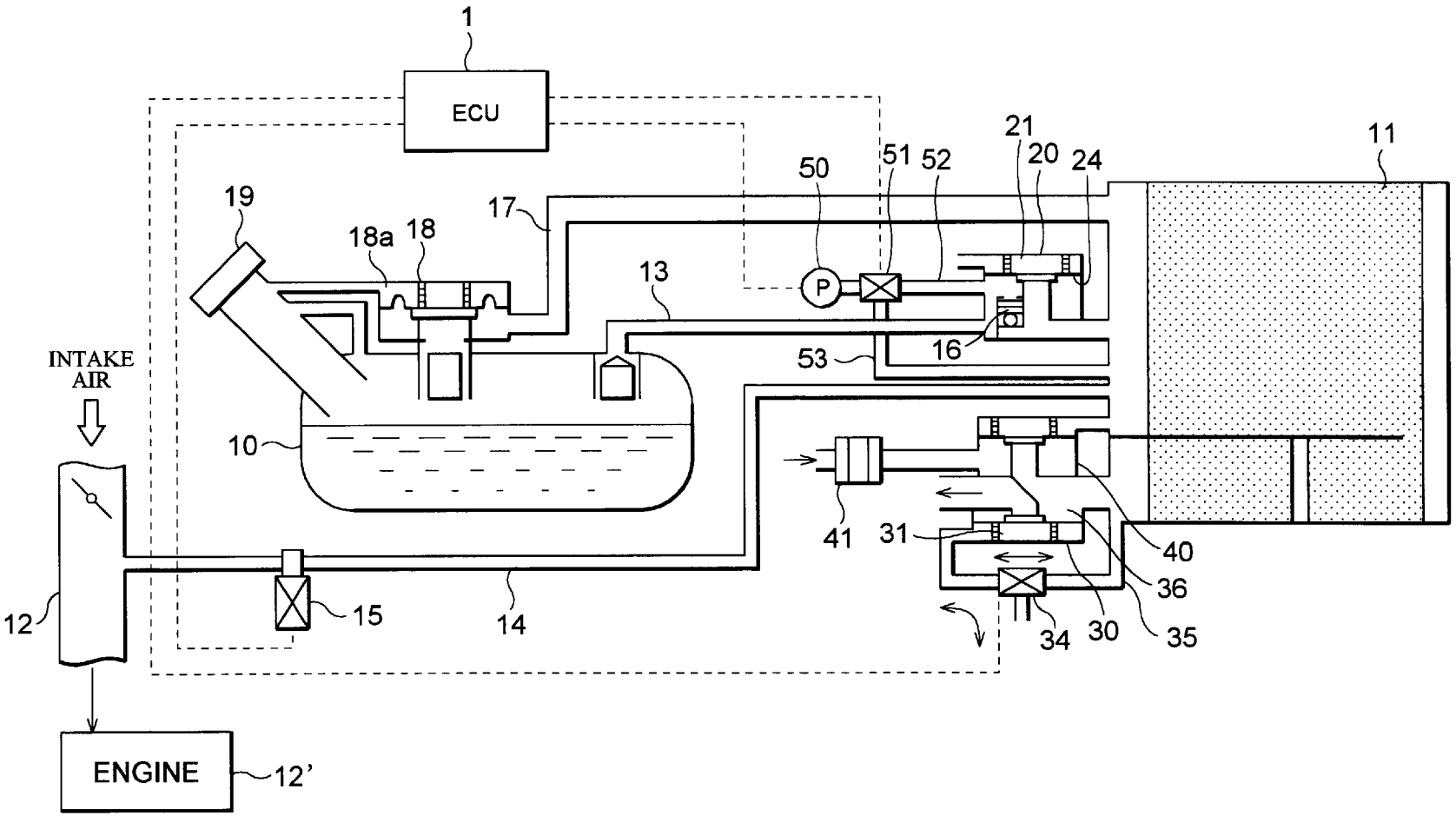
FIG. 14 is a systematic configurational view showing the failure diagnosis apparatus for evaporative purge system in accordance with a fifth embodiment of the present invention.

FIG. 14 shows a fifth embodiment. Here, constituents identical to those in FIG. 4 are referred to with marks identical thereto. In this embodiment, an air valve three-way VSV 34 is connected to the back-pressure chamber 31 of the air release valve 30. Of the two remaining ports of the air valve three-way VSV 34, one is open to the atmosphere, whereas the other is connected to the canister 11 by way of a communicating passage 35. The switching operation of the air valve three-way VSV 34 is controlled by the ECU 1 such that the back-pressure chamber 31 normally communicates with the atmosphere side but, only at a predetermined timing during failure diagnosis, is caused to communicate with the canister 11.

The processing operation of such a failure diagnosis apparatus for evaporative purge system will be explained with reference to the flow chart of FIG. 15.

First, whether purging is being effected or not is judged at S301. The failure diagnosis is not performed when no purging is effected (when it is judged "No" at S301), thereby terminating this routine. When purging is being effected (it is judged "Yes" at S301), by contrast, it is judged whether or not a condition for detecting perforation of the canister 11 is established (S302). This condition is similar to that exemplified at S102 in FIG. 5. When it is judged at S302 that the perforation detecting condition for the canister 11 is not established ("No" at S302), there is a possibility that failure diagnosis may not be performed accurately, whereby the routine is terminated without diagnosis.

When it is judged at S302 that the perforation detecting condition for the canister 11 is established ("Yes" at S302), by contrast, the three-way VSV 51 is switched from the fuel tank side to the canister side (S303), such that the pressure on the side of the canister 11 can be detected by the pressure sensor 50. Also, addition of a counted level in the timing timer is started (S304).

Subsequently, at S305, it is judged whether the counted level of the timing timer has reached t0 or not. When the counted level is earlier than t0 ("No" at S305), the processing actions of S304 and S305 are repeated. In order to stabilize the pressure between the three-way valve 51 and the pressure sensor 50 and to more correctly detect the pressure on the canister side, the pressure on the side of the canister 11 is monitored for a predetermined duration of time.

At the time when the counted level of the timing timer reaches t0 ("Yes" at S305), the purge-cut flag, indicating that purge cutting is in progress, is set to "1," for example, and the purge duty VSV 15 is closed under the control of the ECU 1, thereby cutting the purge (S306).

Then, at S307, it is judged whether the counted level of the timing timer has reached capture timing t1 or not. When the counted level is earlier than the capture timing t1 ("No" at S307), the processing actions of S304 and later are repeated. At the time when the counted level of the timing timer reaches the capture timing t1 ("Yes" at S307), the pressure signal detected by the pressure sensor 50 is captured, and thus captured level is stored in a RAM within the ECU 1 as P1 (S308). Subsequently, at S309, it is judged whether the counted level of the timing timer has reached capture timing t2 or not. When the counted level is earlier than the capture timing t2 ("No" at S309), the processing actions of S304 and later are repeated. At the time when the counted level of the timing timer reaches the capture timing t2 ("Yes" at S309), the pressure signal detected by the pressure sensor 50 is captured, and thus captured level is stored in the RAM within the ECU 1 as P2 (S310).

Subsequently, at S311, P1 and P2 are read out from the RAM, and the pressure difference between P1 and P2, $\Delta P = P1 - P2$, is computed. $\Delta P$ becomes greater in the case where leakage is generated in the system due to perforation than in the case where no leakage is generated. Accordingly, the level of $\Delta P$ is compared with a predetermined judgment level (S312). Consequently, when the level of $\Delta P$ is smaller than the judgment level ("No" at S312), it is judged that perforation is not generated in the canister 11 (S319), whereby the flow shifts to the processing actions of S320 and later, which will be explained later.

When the level of $\Delta P$ is not smaller than the judgment level ("Yes" at S312), by contrast, there is a possibility that misjudgment may be made under the influence of the vapor flowing from the fuel tank 10. The internal pressure of the canister 11 rises to the positive pressure in the case of misjudgment, whereas it is stabilized near the atmospheric pressure in the case where perforation is generated. In order to distinguish these cases from each other, first, the air valve three-way VSV 34 is switched from the atmosphere side to the side of the canister 11 (S313), thereby communicating the back-pressure chamber of the air release valve 30 to the canister 11. While the pressure in the canister 11 is consequently introduced into the back-pressure chamber 31 by way of the communicating passage 35, it is also supplied to the circuit pressure chamber 36. Thus, the same pressure is applied to both the back-pressure chamber 31 and circuit pressure chamber 36.

While the purge-cutting operation is further continued, at S314, the counted level of the timing timer is captured, and it is judged whether or not thus captured level has reached capture timing t3 or not. When the counted level is earlier than the capture timing t3 ("No" at S314), the processing actions of S304 and later are repeated.

At the time when the counted level of the timing timer reaches the capture timing t3 ("Yes" at S314), the pressure signal detected by the pressure sensor 50 is captured, and thus captured level is stored in the RAM within the ECU 1 as P3 (S315).

Subsequently, at S316, P3 is read out from the RAM and is compared with a predetermined judgment level (positive pressure level). When the level of P3 is smaller than the judgment level ("No" at S316), i.e., when the internal pressure of the canister 11 is stabilized near the atmospheric pressure, it is judged that perforation is generated in the canister 11 (S317), and a diagnosis flag is set (S318). When the diagnosis flag is set, the ECU 1 executes a processing action such as lighting of an alarm lamp indicating that a failure has occurred, so as to inform the operator of the generation of failure.

When the level of P3 is not smaller than the judgment level ("Yes" at S316), since it can be judged that the increase in pressure is due to the influence of the vapor generated in the fuel tank 10, it is judged that no failure such as perforation is generated in the canister 11 (S319). Also, in this case, the pressure in the canister 11 (circuit pressure chamber 36) increases under the influence of the vapor flowing from the fuel tank 10, thus increased pressure is introduced into the back-pressure chamber 31 by way of the communicating passage 35, thereby increasing the pressure in the back-pressure chamber 31 as well. Due to such an action, the relative pressure difference between the circuit pressure chamber 36 and the back-pressure chamber 31 becomes substantially constant, whereby the air release valve 30 is prevented from opening. Accordingly, the canister 11 maintains a sealed state therein. Thus, since the sealed state can be maintained in the canister 11, failure diagnosis can also be performed in the case where the internal pressure of the canister 11 shifts to the positive pressure side.

When such a series of judgment operations in failure diagnosis are completed, the air valve three-way VSV 34 switched to the side of the canister 11 upon the failure diagnosis is switched back to the atmosphere side (S320), and the purge-cut flag is cleared (set to "0"; S321). When the purge-cut flag is cleared, the purge duty VSV 15 is opened under the control of the ECU 1, whereby the purge control operation is resumed. Also, the counted level of the timing timer is cleared (S322) so as to be ready for the next failure diagnosis operation. Further, the three-way VSV 51 is switched from the canister side to the fuel tank side such that the pressure sensor 50 can detect the pressure on the side of the fuel tank 10 (S323), thereby terminating this flow.

When the failure diagnosis apparatus for evaporative purge system is configured in this manner, the air release valve 30 can completely be prevented from opening during the failure diagnosis. Accordingly, even in an evaporative purge system employing an ORVR system, the internal pressure of the canister 11 can sufficiently be raised to the positive pressure side, whereby an accurate result of diagnosis can securely be obtained. Also, as with the fourth embodiment, since the air valve three-way VSV 34 communicates with the canister 11 only at the time of failure diagnosis, it does not affect the resistance upon refueling.

Figure 16:
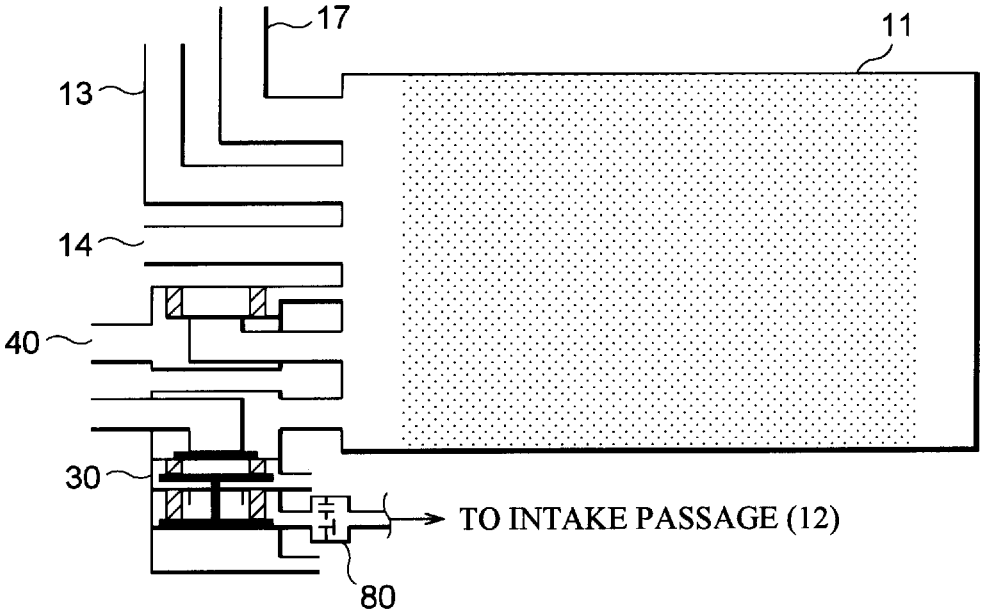
FIG. 16 is a systematic configurational view showing a main part of the failure diagnosis apparatus for evaporative purge system in accordance with a sixth embodiment of the present invention.
Figure 17:
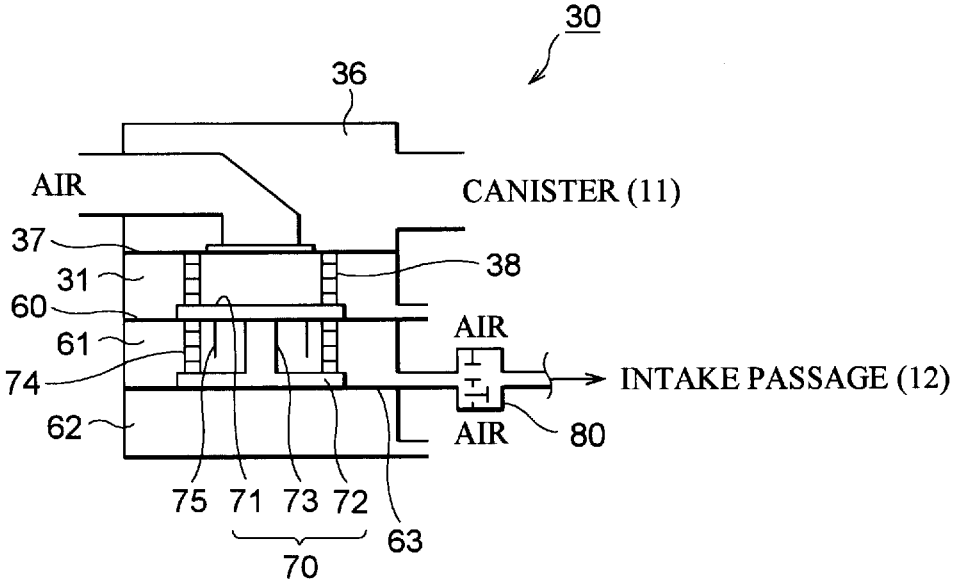
FIG. 17 is an explanatory view showing, under magnification, the state of an air release valve at the time when an engine is stopped.

The air release valve 30 exemplified by FIG. 14 and the like can also be configured in the following manner. FIG. 16 shows a part of the evaporative purge system in accordance with a sixth embodiment, whereas FIG. 17 shows, under magnification, the air release valve 30 shown in FIG. 16. The other part of system configuration is not depicted here since it is the same as that of the fifth embodiment shown in FIG. 14, for example.

As explained above, the air release valve 30 comprises the circuit pressure chamber 36, which communicates with the canister 11, and the back-pressure chamber 31, into which the atmospheric pressure is introduced and to which a predetermined set pressure is applied by the spring force of the spring 38. Further, in this embodiment, a first chamber 61 is disposed so as to adjoin a partition wall 60 of the back-pressure chamber 31, whereas a second chamber 62 communicating with the atmosphere is disposed so as to adjoin the first chamber 61.

Figure 18:
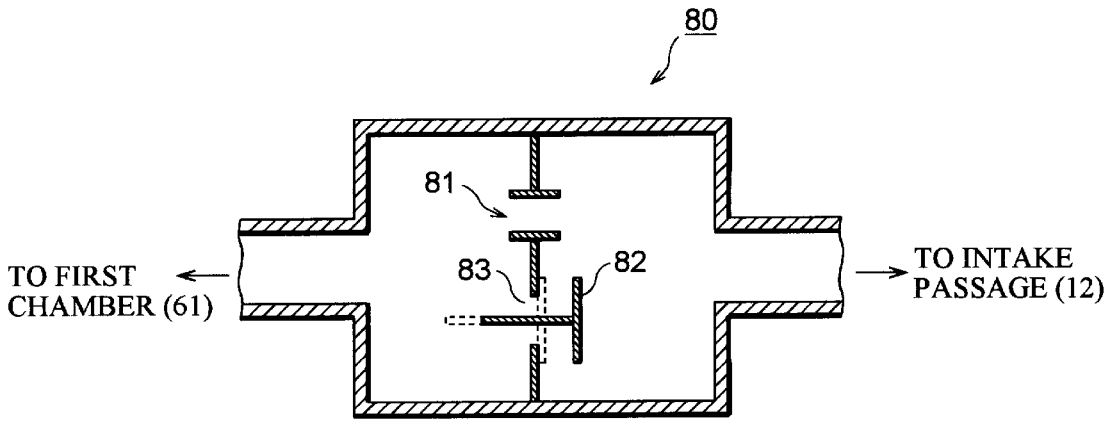
FIG. 18 is an explanatory view schematically showing a configuration of VTV.

The first chamber 61 is connected to the intake passage 12 by way of a VTV (Vacuum Transmitting Valve) 80, whereby the pressure of the intake passage 12 is introduced into the first chamber 61. Accordingly, the atmosphere is introduced into the first chamber 61 during the time when the engine is stopped, whereas the negative pressure of the intake passage 12 is introduced into the first chamber 61 during the engine operation. As shown under magnification in FIG. 18, the VTV 80 comprises a restrictor 81, which is always open, and a movable valve element 82 which is provided for an opening 83. According to the air flow passing through the VTV 80, the movable valve element 82 shifts between the position indicated by dotted line and the position indicated by continuous line, thereby opening and closing the opening 83. The VTV 80 functions to alleviate abrupt pressure changes in the first chamber 61 by means of the restrictor 81 and the movable valve member 82.

Also, plates 71 and 72 are respectively placed in the back-pressure chamber 31 and first chamber 61. The plates 71 and 72 are united together by a pillar 73 airtightly penetrating through the partition wall 60. The plates 71 and 72 and the pillar 73 constitute a movable member 70. Since the plate 72 at one end is secured to a diaphragm 63, the movable member 70 moves together with the diaphragm 63.

A spring 74 is disposed between the plate 72 and the partition wall 60 in the first chamber 61, whereas the above-mentioned spring 38 is disposed between the diaphragm 37 and the plate 71. Accordingly, the movable member 70 is configured to support one end of the spring 38 and one end of the spring 74. Here, numeral 75 refers to a stopper which comes into contact with the movable member 70 so as to restrict the movement of the latter.

In the following, the operation of thus configured air release valve 30 will be explained. During the time when the engine is stopped, the pressure of the intake passage 12 (intake pressure) is the atmospheric pressure, which is introduced into the first chamber 61. Accordingly, both the first and second chambers 61 and 62 attain the atmospheric pressure and are balanced with each other, whereby the movable member 17 is positioned as shown in FIG. 17. At this time, the valve opening pressure of the air release valve 30 is defined by the pressure of the spring 38. In this embodiment, since an ORVR system is employed, the valve opening pressure is set to a relatively low level near the atmospheric pressure.

Figure 19:
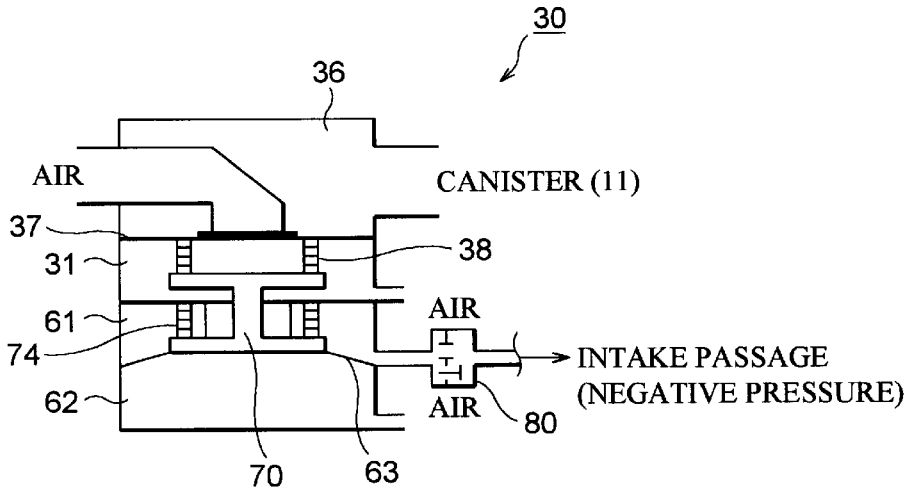
FIG. 19 is an explanatory view showing the state of the air release valve during engine operation.
Figure 20:
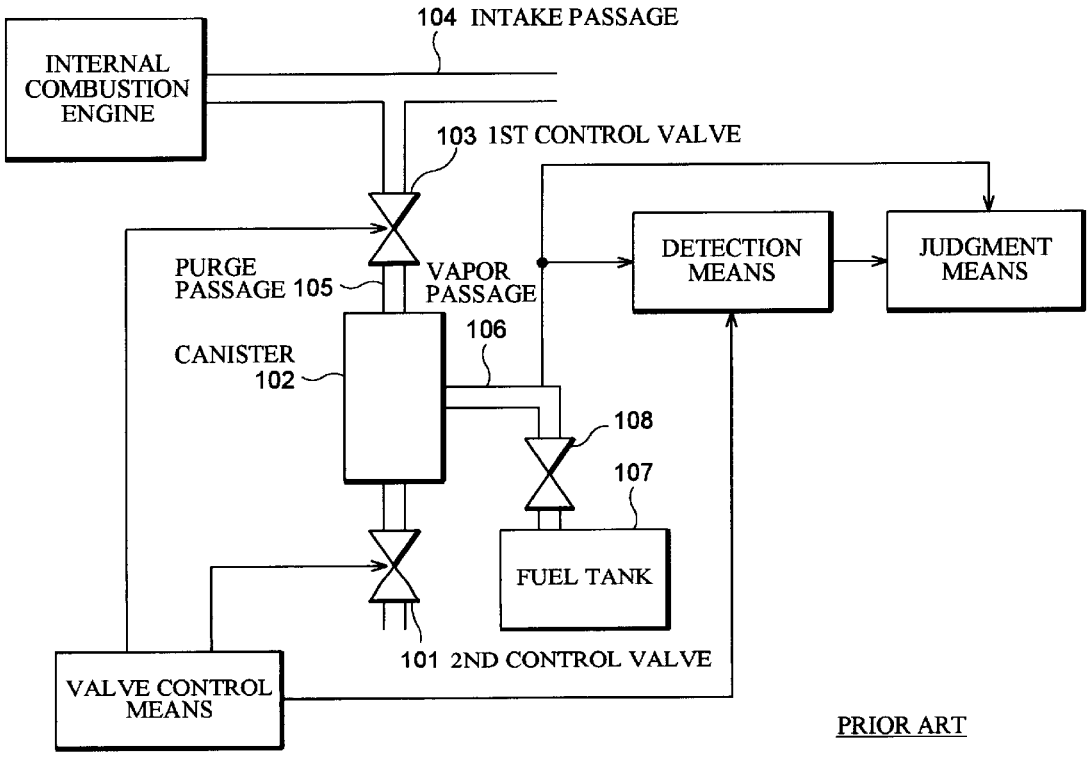
FIG. 20 is a schematic configurational view showing a conventional failure diagnosis apparatus for evaporative purge system.
Figure 21:
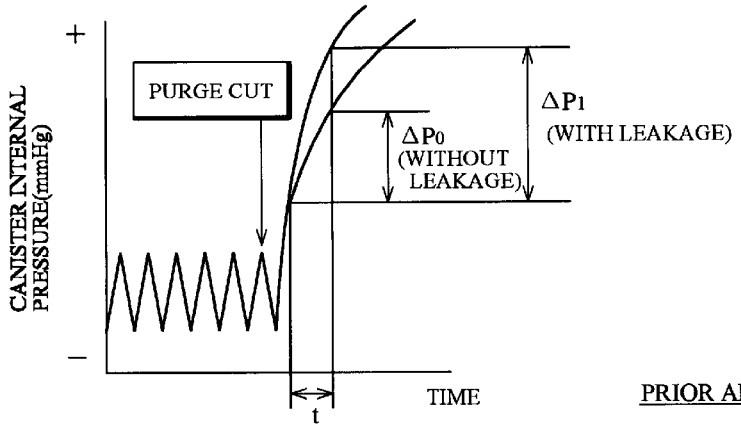
PRIOR ART Fig.21
FIG. 21 is a graph for explaining how the canister internal pressure changes in the negative pressure region depending on whether leakage occurs or not.
Figure 22:
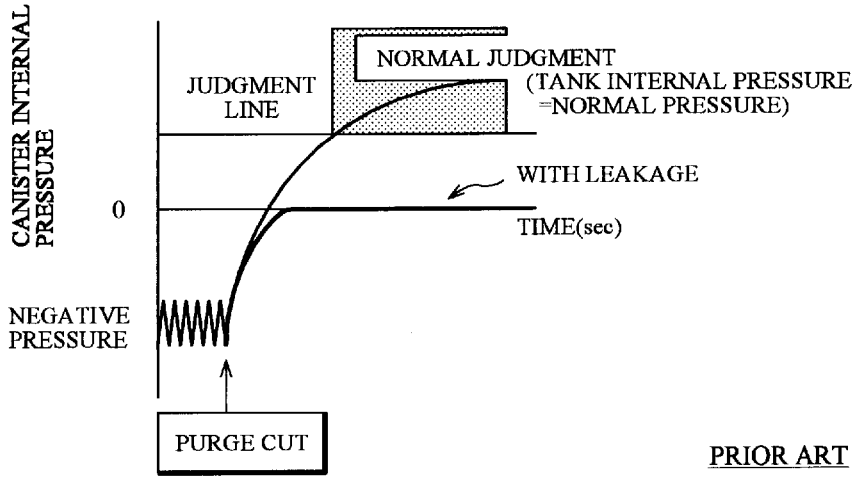
FIG. 22 is a graph for explaining how the canister internal pressure changes in the positive pressure region depending on whether leakage occurs or not.
Figure 23:
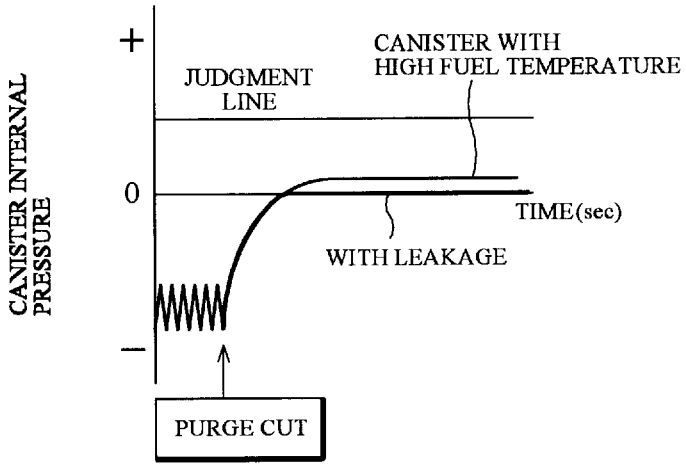
PRIOR ART Fig.23
FIG. 23 is a graph exemplifying a change in the canister internal pressure at the time of failure diagnosis.

During the engine operation, on the other hand, since the negative pressure of the intake passage 12 is introduced into the first chamber 61, the diaphragm 63 deforms as shown in FIG. 19, whereby the space occupied by the first chamber 61 is narrowed, whereas the space occupied by the second chamber 62 becomes wider. Consequently, the movable member 70 is pushed up, thereby compressing the spring 38 in the back-pressure chamber 31. Accordingly, the force pushing the diaphragm 37 becomes stronger, thereby increasing the valve opening pressure of the air release valve 30.

When the negative pressure in the intake passage 12 gradually rises to the atmospheric pressure, for example, at the time when the engine stops, the pressure difference between the first and second chambers 61 and 62 gradually decreases. Accordingly, due to the resilience of the springs 38 and 74, the movable member 70 returns to the position shown in FIG. 17.

Due to such an operation, the valve opening pressure of the air release valve 30 becomes a relatively low pressure during the time when the engine is stopped, e.g., at the time of refueling, while the valve opening pressure of the air release valve 30 can be increased during the engine operation, at which failure diagnosis is performed. Accordingly, even in the evaporative purge system employing an ORVR system, the internal pressure of the canister 11 can sufficiently be raised to the positive pressure side at the time of failure diagnosis, whereby an accurate result of diagnosis can be obtained. Also, as a mechanical valve of diaphragm type is employed, the valve opening pressure of the air release valve 30 can be altered with a simple configuration.

As explained in the foregoing, the failure diagnosis apparatus for evaporative purge system in accordance with each aspect of the present invention is equipped with valve opening suppressing means for suppressing the opening operation of the pressure regulating valve for adjusting the pressure in the evaporative purge system during the failure diagnosis. Accordingly, failure diagnosis can be prevented from becoming erroneous as the pressure regulating valve in the evaporative purge system opens during the diagnosis, whereby the failure can be diagnosed more accurately.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Applications No. 8-149380 (149380/1996) filed on Jun. 11, 1996 and No. 9-004765 (004765/1997) filed on Jan. 14, 1997 are hereby incorporated by reference.

What is claimed is:

1. A failure diagnosis apparatus for diagnosing failure of an evaporative purge system, said evaporative purge system extending from a fuel tank to a purge passage, said fuel tank being connected to a canister by way of a vapor passage, said purge passage connecting said canister to an intake passage of an internal combustion engine, said failure diagnosis apparatus comprising:

pressure detecting means for detecting a pressure in a predetermined section within said evaporative purge system;

evaluating means for evaluating, according to a change in pressure detected by said pressure detecting means, whether there is a failure in said predetermined section or not;

a pressure regulating valve for adjusting the pressure within said evaporative purge system; and valve opening suppressing means for restraining the opening of said pressure regulating valve during the failure diagnosis.

2. An apparatus according to claim 1, wherein said valve opening suppressing means is a vapor-cut valve arranged in said vapor passage, and wherein said vapor-cut valve is closed during the failure diagnosis.

3. An apparatus according to claim 1, wherein said pressure regulating valve is a tank internal pressure regulating valve having a back-pressure chamber to which a predetermined pressure is applied and a circuit pressure chamber to which the pressure in said fuel tank is applied by way of said vapor passage, said tank internal pressure regulating valve being adapted to open when the pressure in said circuit pressure chamber is greater than the pressure of said back-pressure chamber, thereby communicating said fuel tank and said canister to each other; and wherein said valve opening suppressing means is a communicating passage through which the pressure in said canister is introduced into the back-pressure chamber of said tank internal pressure regulating valve.

4. An apparatus according to claim 1, wherein said pressure regulating valve is an air release valve having a back-pressure chamber to which a predetermined pressure is applied and a circuit pressure chamber to which the pressure in said canister is applied, said air release valve being adapted to open when the pressure in said circuit pressure chamber is greater than the pressure of said back-pressure chamber, thereby opening said canister to an atmosphere; and wherein said valve opening suppressing means is set pressure changing means for changing a pressure setting in the back-pressure chamber of said air release valve.

5. An apparatus according to claim 1, wherein said pressure regulating valve is an air release valve having a back-pressure chamber to which a predetermined pressure is applied and a circuit pressure chamber to which the pressure in said canister is applied, said air release valve being adapted to open when the pressure in said circuit pressure chamber is greater than the pressure of said back-pressure chamber, thereby opening said canister to an atmosphere; and wherein said valve opening suppressing means comprises a first chamber into which the pressure of said intake passage is introduced, a second chamber into which the atmospheric pressure is introduced, and a movable member which moves in response to a difference in pressure between said first and second chambers so as to raise the valve opening pressure of said air release valve.

6. A failure diagnosis apparatus for an evaporative purge system, said evaporative system having: a fuel tank; a canister; a vapor passage connecting said fuel tank and said canister; an intake passage for an internal combustion engine; and a purge passage connecting said canister and said intake passage, said failure diagnosis apparatus comprising:

a pressure sensor attached to said evaporative purge system;

an electronic control unit connected to said pressure sensor, said unit sampling the output of said sensor during a predetermined period, and determining the failure by evaluating the change in said output;

a pressure regulating valve attached to said evaporative purge system; and a vapor-cut valve arranged in said vapor passage, wherein said vapor-cut valve is closed during said predetermined period.

7. A failure diagnosis apparatus for an evaporative purge system, said evaporative system having: a fuel tank; a canister; a vapor passage connecting said fuel tank and said canister; an intake passage for an internal combustion engine; and a purge passage connecting said canister and said intake passage, said failure diagnosis apparatus comprising:

a pressure sensor attached to said evaporative purge system;

an electronic control unit connected to said pressure sensor, said unit sampling the output of said sensor during a predetermined period, and determining the failure by evaluating the change in the output; and a tank internal pressure regulating valve attached to said evaporative purge system, having a back-pressure chamber to which a predetermined pressure is applied and a circuit pressure chamber to which the pressure in said fuel tank is applied by way of said vapor passage, said tank internal pressure regulating valve being adapted to open when the pressure in said circuit pressure chamber is greater than the pressure of said back-pressure chamber, thereby communicating said fuel tank and said canister to each other;

a communicating passage through which the pressure in said canister is introduced into the back-pressure chamber of said tank internal pressure regulating valve.

8. A failure diagnosis apparatus for an evaporative purge system, said evaporative system having: a fuel tank; a canister; a vapor passage connecting said fuel tank and said canister; an intake passage for an internal combustion engine; and a purge passage connecting said canister and said intake passage, said failure diagnosis apparatus comprising:

a pressure sensor attached to said evaporative purge system;

an electronic control unit connected to said pressure sensor, said unit sampling the output of said sensor during a predetermined period, and determining the failure by evaluating the change in the output;

an air release valve attached to said evaporative purge system, having a back-pressure chamber to which a predetermined pressure is applied and a circuit pressure chamber to which the pressure in said canister is applied, said air release valve being adapted to open when the pressure in said circuit pressure chamber is greater than the pressure of said back-pressure chamber, thereby opening said canister to an atmosphere; and an air valve connected to said back-pressure chamber, wherein said predetermined pressure can be changed by control of said air valve.

9. A failure diagnosis apparatus for an evaporative purge system, said evaporative system having: a fuel tank; a canister; a vapor passage connecting said fuel tank and said canister; an intake passage for an internal combustion engine; and a purge passage connecting said canister and said intake passage, said failure diagnosis apparatus comprising:

a pressure sensor attached to said evaporative purge system;

an electronic control unit connected to said pressure sensor, said unit sampling the output of said sensor in a predetermined period, and determining the failure by evaluating the change in the output;

an air release valve attached to said evaporative purge system, having a back-pressure chamber to which a predetermined pressure is applied and a circuit pressure chamber to which the pressure in said canister is applied, said air release valve being adapted to open when the pressure in said circuit pressure chamber is greater than the pressure of said back-pressure chamber, thereby opening said canister to an atmosphere;

a first chamber into which the pressure of said intake passage is introduced;

a second chamber into which the atmospheric pressure is introduced; and a movable member which moves in response to a difference in pressure between said first and second chambers so as to raise the valve opening pressure of said air release valve.

* * * * *